US008545163B2

(12) United States Patent
Yasuda et al.

(10) Patent No.: US 8,545,163 B2
(45) Date of Patent: Oct. 1, 2013

(54) LOADER WORK MACHINE

(75) Inventors: Toyoaki Yasuda, Osaka (JP); Masanori Fujino, Sakai (JP); Toshihiko Takemura, Izumi (JP); Yasuo Nakata, Sakai (JP); Yoshitaka Matsubara, Osaka (JP); Yoshihiro Ueda, Sakai (JP); Yuuki Takano, Sakai (JP); Yusuke Kawai, Sakai (JP); Ryohei Sumiyoshi, Sakai (JP); Hiroyuki Anami, Kaizuka (JP); Naoya Muramoto, Sakai (JP); Kenji Mitsui, Sakai (JP); Youhei Kawano, Sakai (JP); Takeshi Ikumura, Sakai (JP)

(73) Assignee: Kubota Corporation, Osaka (JP)

( * ) Notice: Subject to any disclaimer, the term of this patent is extended or adjusted under 35 U.S.C. 154(b) by 709 days.

(21) Appl. No.: 12/529,970

(22) PCT Filed: Mar. 23, 2009

(86) PCT No.: PCT/JP2009/055628

§ 371 (c)(1),
(2), (4) Date: Jan. 26, 2010

(87) PCT Pub. No.: WO2009/157230

PCT Pub. Date: Dec. 30, 2009

(65) Prior Publication Data

US 2010/0143087 A1 Jun. 10, 2010

(30) Foreign Application Priority Data

| | | |
|---|---|---|
| Jun. 26, 2008 | (JP) | 2008-167356 |
| Jul. 22, 2008 | (JP) | 2008-188670 |
| Sep. 3, 2008 | (JP) | 2008-226305 |
| Sep. 3, 2008 | (JP) | 2008-226306 |
| Sep. 3, 2008 | (JP) | 2008-226307 |
| Sep. 3, 2008 | (JP) | 2008-226308 |
| Sep. 3, 2008 | (JP) | 2008-226309 |
| Sep. 5, 2008 | (JP) | 2008-228360 |
| Sep. 12, 2008 | (JP) | 2008-234103 |

(51) Int. Cl.
*E02F 3/34* (2006.01)
*E02F 3/28* (2006.01)

(52) U.S. Cl.
USPC ..... 414/706; 414/680; 414/685; 414/686; 414/697; 414/917

(58) Field of Classification Search
USPC ..... 414/686, 685, 680, 917, 697, 706
See application file for complete search history.

(56) References Cited

U.S. PATENT DOCUMENTS

| | | | | |
|---|---|---|---|---|
| 6,616,398 | B2 | 9/2003 | Dershem et al. | |
| 7,264,435 | B2 | 9/2007 | Layko et al. | |
| 2006/0243234 | A1 * | 11/2006 | Shibuya | 123/90.16 |
| 2007/0128012 | A1 | 6/2007 | Yamada et al. | |

FOREIGN PATENT DOCUMENTS

| | | | |
|---|---|---|---|
| JP | 2006-307498 | * | 11/2006 |
| JP | 2007154519 | A | 6/2007 |

* cited by examiner

*Primary Examiner* — Scott Lowe
(74) *Attorney, Agent, or Firm* — The Webb Law Firm

(57) ABSTRACT

Positional relationship among the first link support shaft (85), the second link support shaft (86), the first arm support shaft (88) and the second arm support shaft (89) is set such that an upper portion of the first lift link (81) comes into substantial agreement with a rear end of the machine body (1), when the upper free end of the first lift link (81) is pivoted maximally rearward in the course of transition of the arm (77) from a lowermost state realized lifting down the arm (77) to an uppermost state realized by lifting up the arm (77).

10 Claims, 13 Drawing Sheets

LOADER WORK MACHINE

TECHNICAL FIELD

The present invention is directed to a loader work machine.

BACKGROUND ART

Conventionally, there is known a loader work machine as under (see, e.g. Patent Documents 1 and 2):—

A loader work machine comprising:

a driving section provided upwardly of a machine body frame;

a pair of right/left arms provided on right/left sides of the machine body frame and the driving section, respectively;

an implement provided between leading ends of the pair of right/left arms;

a pair of right/left traveling devices supporting the machine body frame;

a pair of right/left first lift links and a pair of right/left second lift links disposed forwardly of the first lift links for vertically pivotally supporting base portions of the respective arms at a rear upper portion of the machine body frame;

an arm cylinder provided between the base portion of the arm associated therewith and a rear lower portion of the machine body frame for lifting up/down the arm;

a first link support shaft for pivotally supporting a lower base portion of the first lift link associated therewith to the machine body frame;

a second link support shaft for pivotally connecting a base portion of the second lift link associated therewith to the machine body frame, at a position forwardly of the first link support shaft;

a first arm support shaft for pivotally supporting a base portion of the arm to an upper free end of the first lift link;

a second arm support shaft for pivotally connecting a base portion of the arm to a free end of the second lift link, at a position forwardly of the first arm support shaft;

a lower cylinder support shaft for pivotally connecting a lower end of the arm cylinder to the machine body frame; and an upper cylinder support shaft for pivotally connecting an upper leading end portion of the arm cylinder to the base portion of the arm;

a leading end of the arm being lifted up/down forwardly of the machine body frame.

With the conventional loader work machine of this type, in the course of lifting up/down the arm, the first lift link is inclined upwardly rearwardly to project significantly rearward from a rear end of a vehicle body of the loader work machine.

Patent Document 1: U.S. Pat. No. 7,264,435 B2

Patent Document 2: U.S. Pat. No. 6,616,398 B2

DISCLOSURE OF THE INVENTION

In the case of the conventional loader work machine, in the course of lifting up/down the arm, the first lift link is inclined upwardly rearwardly to project significantly rearward from the rear end of the vehicle body of the loader work machine. Thus, there is high risk of the rear link hitting an object present rearwardly of the loader work machine during work, thus interfering with the work.

In view of the above-described drawback, an object of the present invention is to prevent such significant rearward projection of the first lift cylinder from the rear end of the vehicle body of the loader work machine in the course of lifting up/down the arm, thus preventing the first lift link from hitting an object present rearwardly of the loader work machine thus preventing the first lift link from interfering with the work.

The above object is fulfilled, according to a first aspect of a loader work machine relating to the present invention as under:—

A loader work machine comprising:

a driving section provided upwardly of a machine body frame;

a pair of right/left arms provided on right/left sides of the machine body frame and the driving section, respectively;

an implement provided between leading ends of the pair of right/left arms;

a pair of right/left traveling devices supporting the machine body frame;

a pair of right/left first lift links and a pair of right/left second lift links disposed forwardly of the first lift links for vertically pivotally supporting base portions of the respective arms at a rear upper portion of the machine body frame;

an arm cylinder provided between the base portion of the arm associated therewith and a rear lower portion of the machine body frame for lifting up/down the arm;

a first link support shaft for pivotally supporting a lower base portion of the first lift link associated therewith to the machine body frame;

a second link support shaft for pivotally connecting a base portion of the second lift link associated therewith to the machine body frame, at a position forwardly of the first link support shaft;

a first arm support shaft for pivotally supporting a base portion of the arm to an upper free end of the first lift link;

a second arm support shaft for pivotally connecting a base portion of the arm to a free end of the second lift link, at a position forwardly of the first arm support shaft;

a lower cylinder support shaft for pivotally connecting a lower end of the arm cylinder to the machine body frame; and an upper cylinder support shaft for pivotally connecting an upper leading end portion of the arm cylinder to the base portion of the arm;

a leading end of the arm being lifted up/down forwardly of the machine body frame;

wherein positional relationship among the first link support shaft, the second link support shaft, the first arm support shaft and the second arm support shaft is set such that an upper portion of the first lift link comes into substantial agreement with a rear end of the machine body, when the upper free end of the first lift link is pivoted maximally rearward in the course of transition of the arm from a lowermost state realized by lifting down the arm in response to contraction of the arm cylinder to an uppermost state realized by lifting up the arm in response to expansion of the arm cylinder.

According to a second aspect of a loader work machine relating to the present invention:— the first arm support shaft is provided at the upper end of the first lift link, and when the arm is lifted up/down to bring the second link support shaft, the first arm support shaft and the second arm support shaft into alignment with a straight line, the first lift link is inclined upwardly rearward and the first arm support shaft is positioned forwardly of the rear end of the machine body.

According to a third aspect of a loader work machine relating to the present invention:— under the lowermost state, the second arm support shaft projects toward the first link support shaft from a segment interconnecting the second link support shaft and the first arm support shaft, and a segment interconnecting the second link support shaft and the second arm support shaft intersects at an obtuse angle with a segment interconnecting the first arm support shaft and the second arm support shaft.

According to a fourth aspect of a loader work machine relating to the present invention:— a distance between the first link support shaft and the first arm support shaft is set longer than a distance between the second link support shaft and the second arm support shaft.

According to a fifth aspect of a loader work machine relating to the present invention:— a distance between the first arm support shaft and the second arm support shaft is set shorter than a distance between the first link support shaft and the first arm support shaft.

According to a sixth aspect of a loader work machine relating to the present invention:— the second link support shaft is disposed forwardly of a drive shaft of the traveling device associated therewith.

According to a seventh aspect of a loader work machine relating to the present invention:— under the lowermost state, the second lift link is inclined upwardly rearward.

According to an eighth aspect of a loader work machine relating to the present invention:— under the lowermost state, the first arm support shaft is located rearwardly of the first link support shaft.

According to a ninth aspect of a loader work machine relating to the present invention:— the first link support shaft is disposed rearwardly of the lower cylinder support shaft.

According to a tenth aspect of a loader work machine relating to the present invention:— under the lowermost state, the arm cylinder is disposed substantially perpendicular to a connecting line interconnecting the first arm support shaft and an implement support shaft that pivotally connects the implement to the leading end of the arm.

According to an eleventh aspect of a loader work machine relating to the present invention:— in the course of transition from the lowermost state of the arm to the uppermost state of the same, the second lift link is always inclined upwardly rearward.

According to a twelfth aspect of a loader work machine relating to the present invention:— with lift up/down operation of the arm in response to expansion/contraction of the arm cylinder, the second lift link is vertically pivoted within a range smaller than 90 degrees.

With the present inventive construction described above, positional relationship among the first link support shaft, the second link support shaft, the first arm support shaft and the second arm support shaft is set such that an upper portion of the first lift link comes into substantial agreement with a rear end of the machine body, in the course of transition of the arm from a lowermost state realized by lifting down the arm in response to contraction of the arm cylinder to an uppermost state realized by lifting up the arm in response to expansion of the arm cylinder. Therefore, in the course of lifting up/down the arm, no significant projection of the first lift cylinder from the rear end of the vehicle body occurs. As a result, it is possible to prevent the first lift link from hitting an object present rearwardly of the loader work machine, thus interfering with the work. Accordingly, it is possible to prevent the first lift link from contacting the rear object when the loader work machine travels backward. Further, as the first lift link does not project significantly rearward, the workability in a narrow limited place can be improved.

BEST MODE OF EMBODYING THE INVENTION

General Construction

One embodiment of a loader work machine implementing the present invention will be described next with reference to the accompanying drawings.

Figure 1:
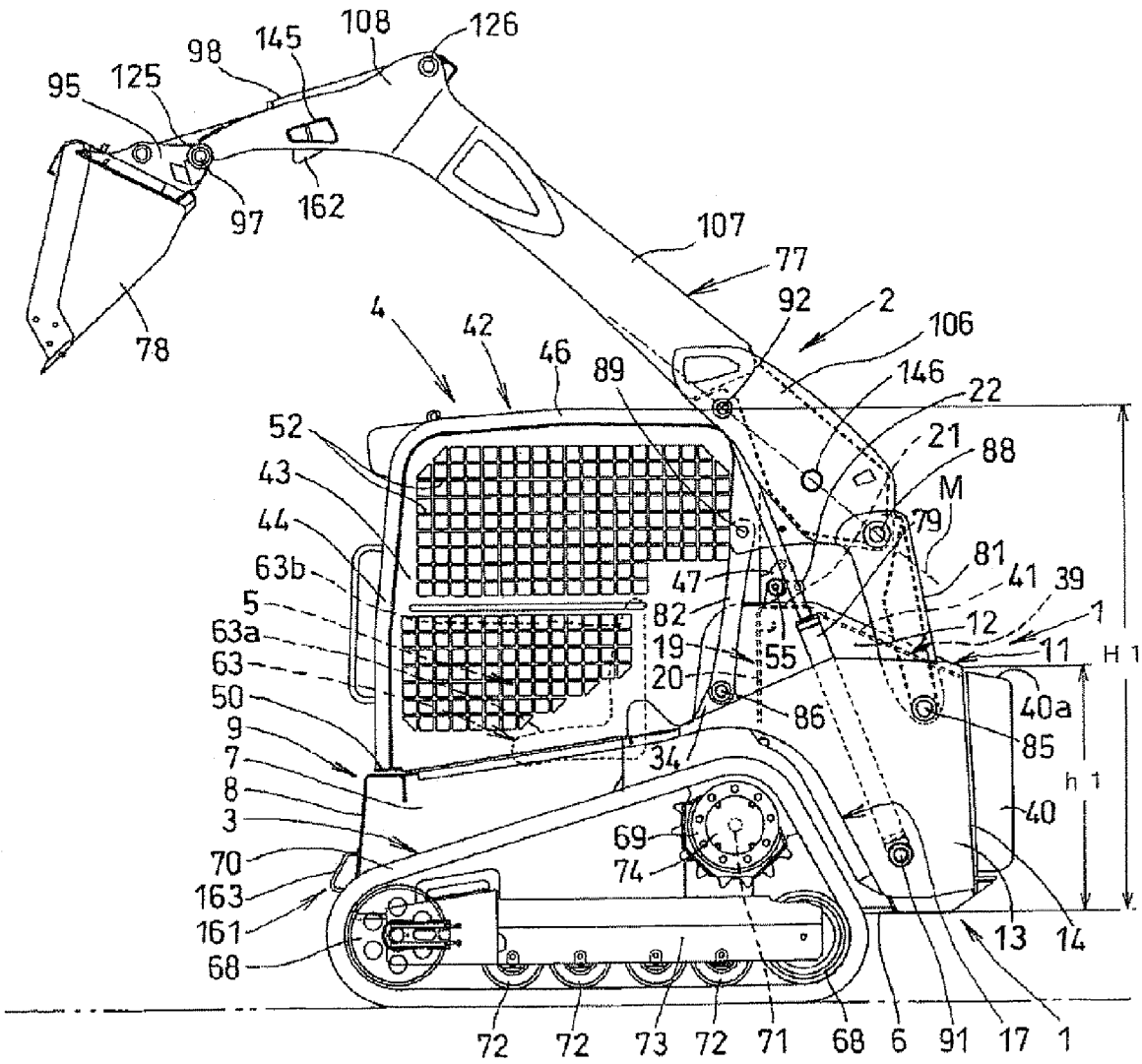
FIG. 1 is a side view of a loader work machine when an arm is under an uppermost state.
Figure 2:
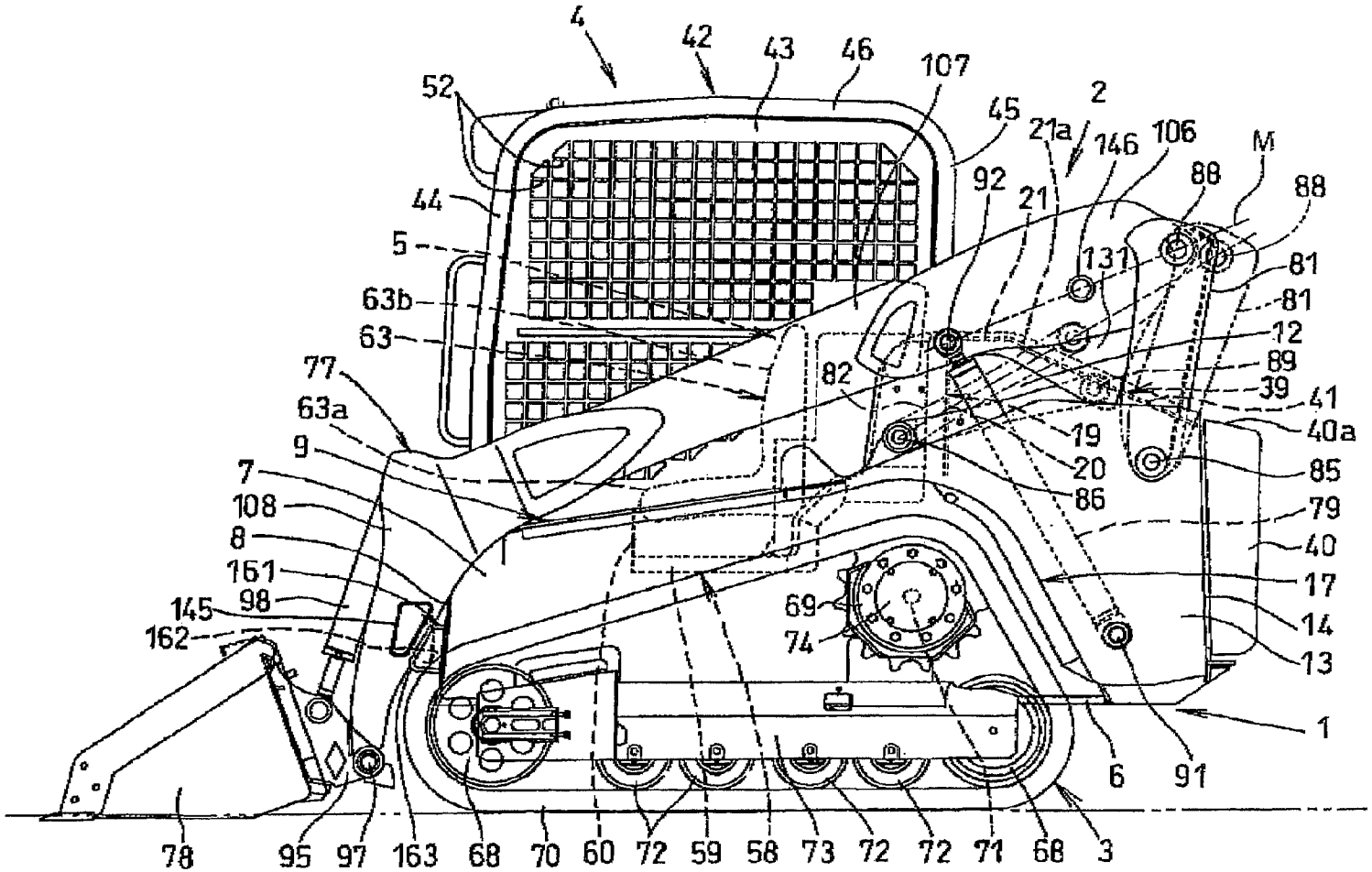
FIG. 2 is a side view of the loader work machine when an arm is under a lowermost state.
Figure 3:
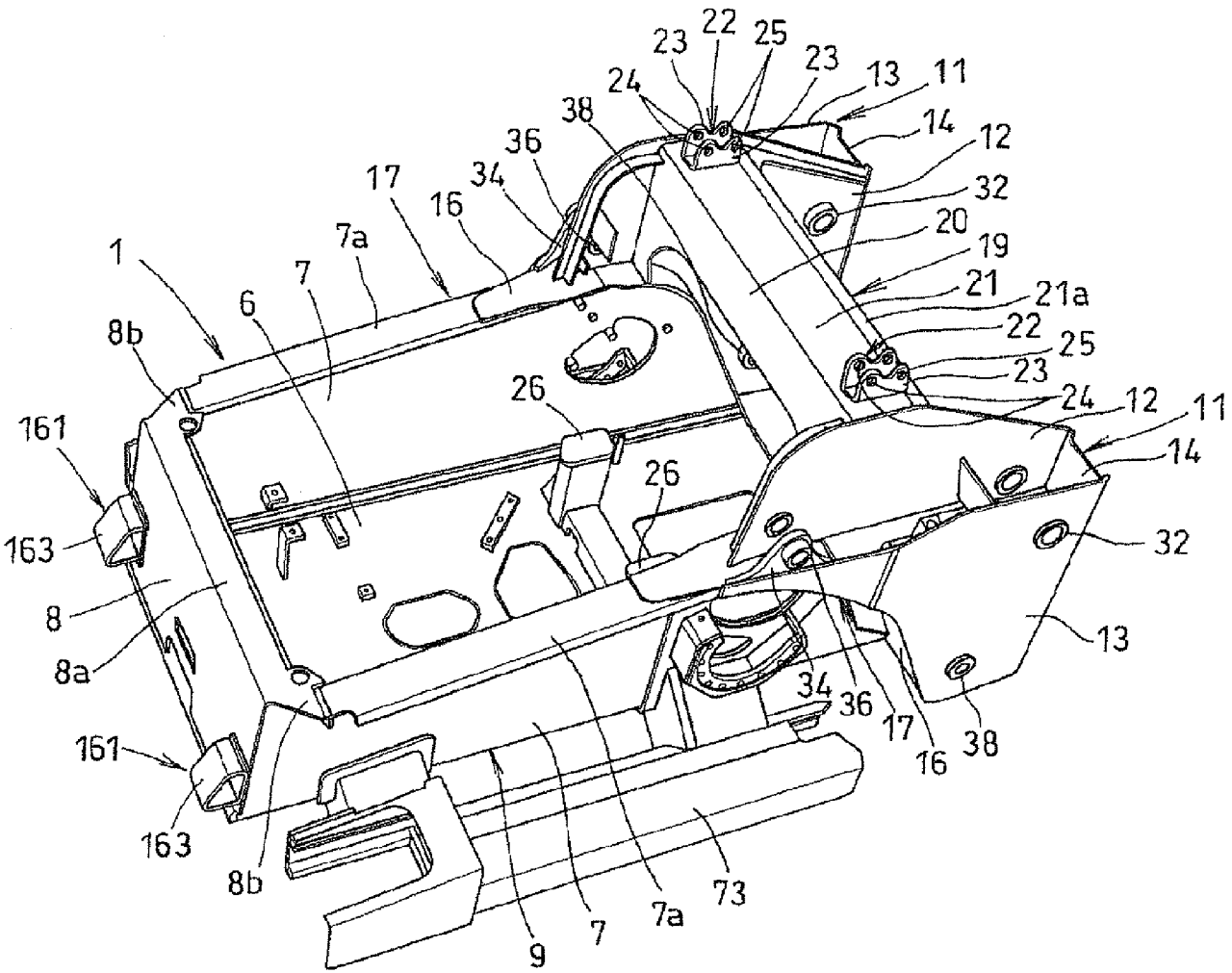
FIG. 3 is a perspective view showing a machine body frame of the loader work machine as viewed from its front upper side.
Figure 4:
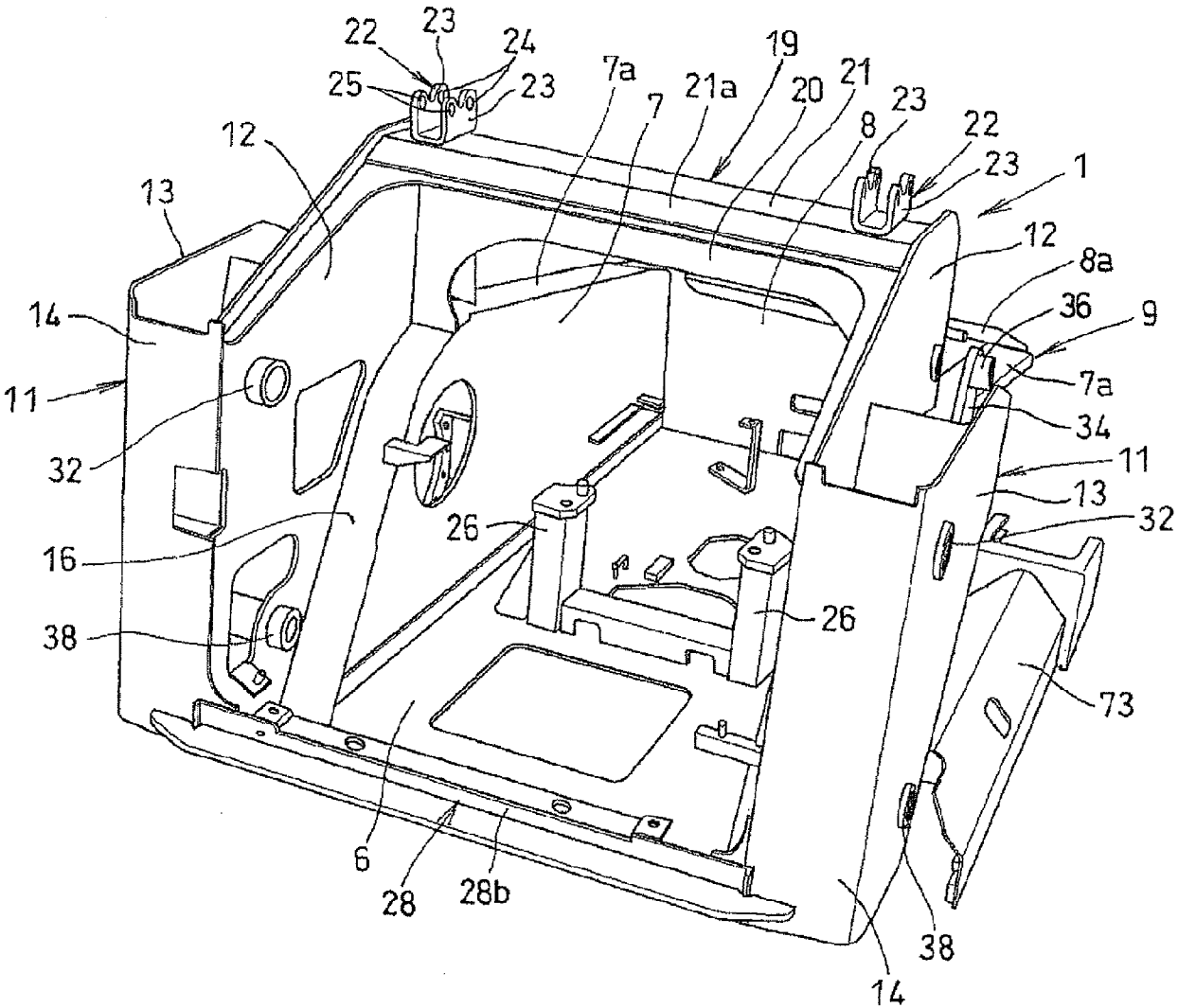
FIG. 4 is a perspective view showing the machine body frame as viewed from its rear side.
Figure 5:
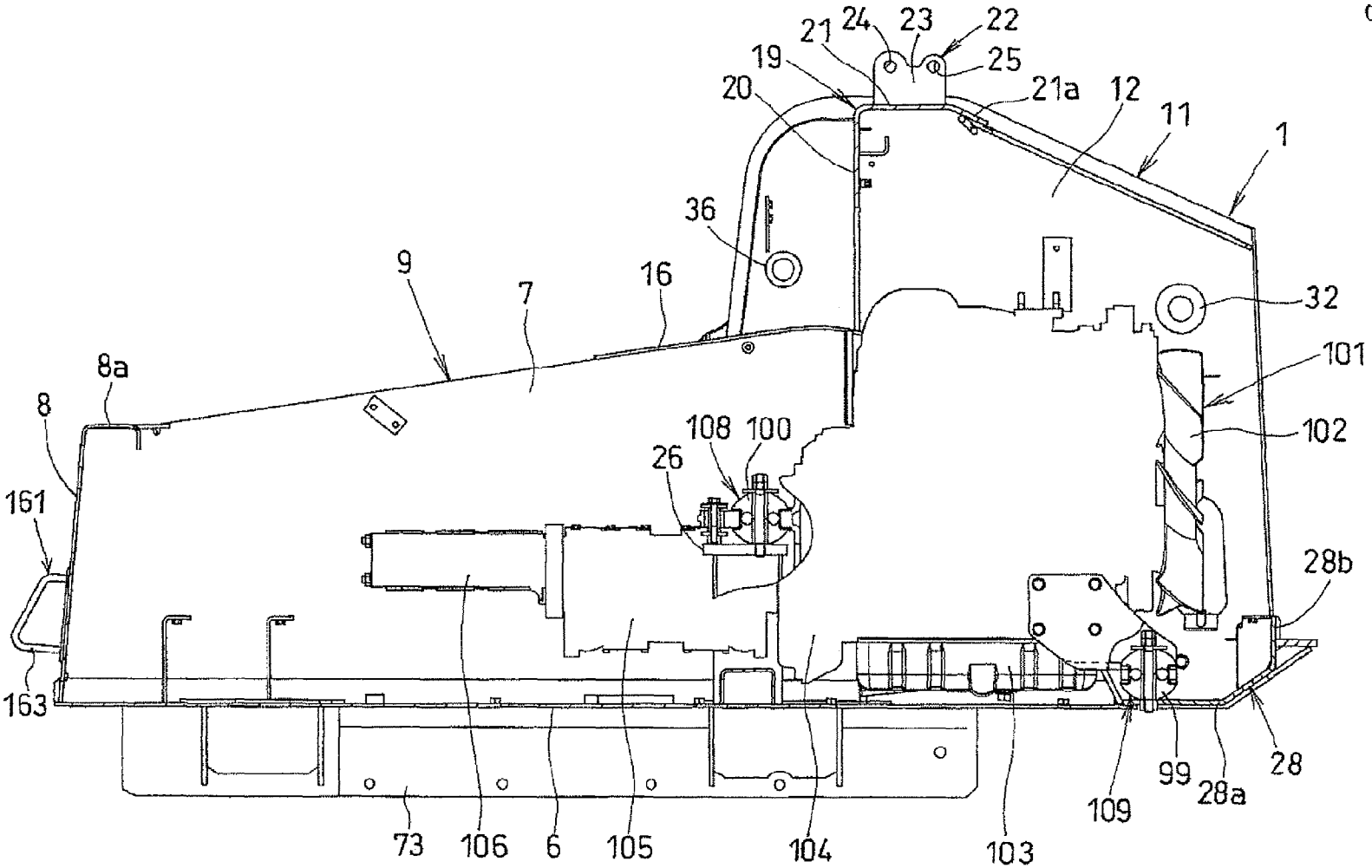
FIG. 5 is a side view in vertical section showing a portion of the machine body frame.
Figure 6:
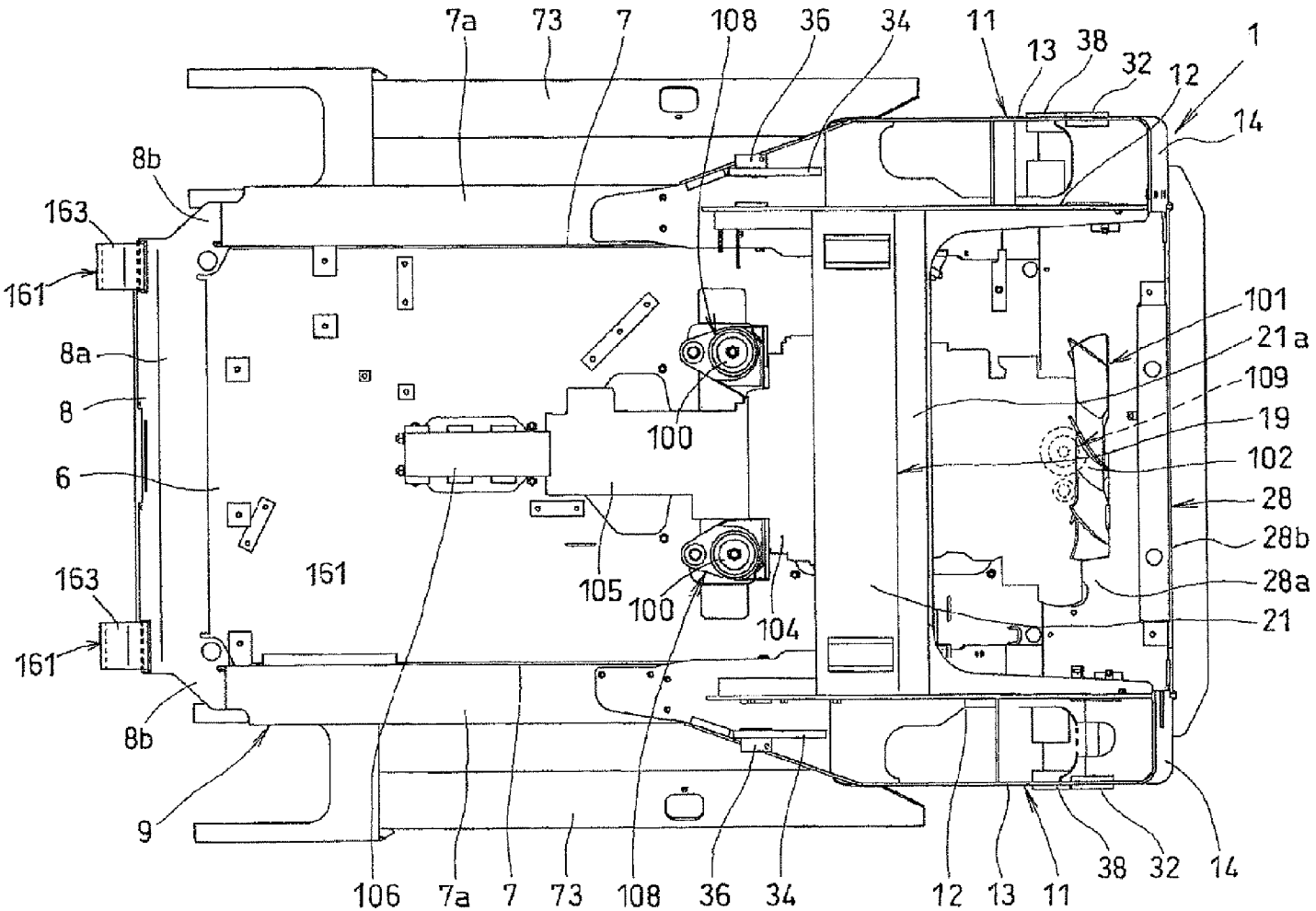
FIG. 6 is a plan view showing the machine body frame portion.
Figure 7:
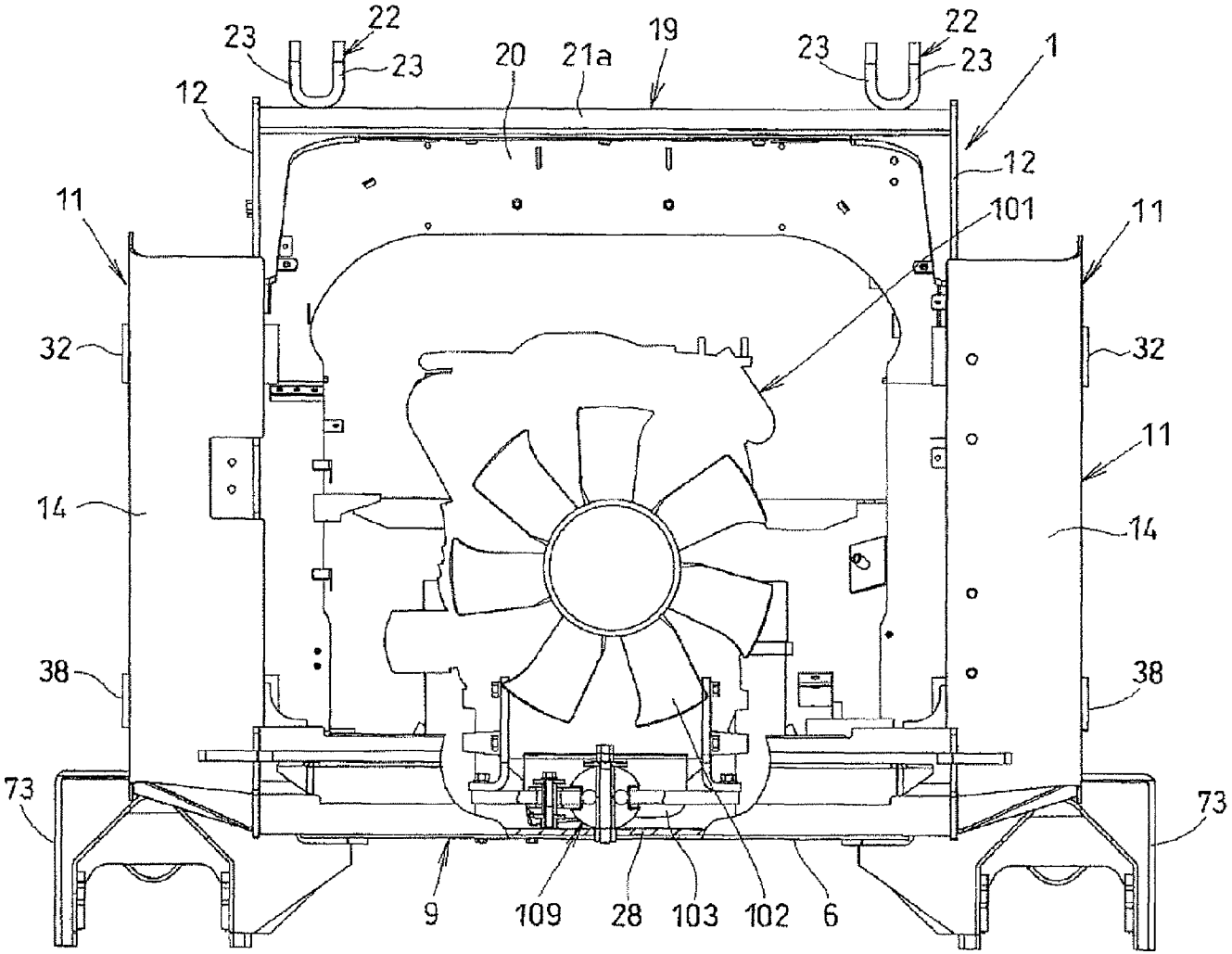
FIG. 7 is a rear view showing the machine body frame portion.

With reference to FIG. 1 and FIG. 2, a truck loader, one example of a loader work machine directed to the present invention, includes a machine body frame 1, a loader implement (excavating implement) 2 mounted on the machine body frame 1, and a pair of right/left traveling devices 3 supporting the machine body frame 1. Upwardly of the machine body frame 1, there is provided a driving section 5 having a driver's seat 63 to be described later, a steering lever, etc. On a front portion of the machine body frame 1, there is mounted a cabin (ROPS: Rollover Protection Structure) 4 surrounding the driving section 5. The loader implement 2 includes a pair of right/left arms 77, and a bucket (implement) 78 mounted between leading end portions of the arms 7.

(Constructions of Frame and Hood)

In FIGS. 3-7, the machine body frame 1 formed of iron plates etc. includes a frame body 9 and a pair of right/left support frame members 11. The pair of right/left support frame members 11 are connected to a rear end of the frame body 9 by welding. The frame body 9 is formed like a top-opened box-like unit having a bottom wall 6, a pair of right/left side walls 7 and a front wall 8. The upper edge of the rear end of each one of the pair of right/left side walls 7 is formed arcuate with a rear downward inclination, with the edge extending progressively downward. At the upper end of each one of the pair of right/left side walls 7, there is provided a bent edge portion 7*a* projecting outward in the right/left direction. At the upper end of the front wall 8, there is provided a bent edge portion 8*a* and from the right/left opposed sides of the bent edge portion 8*a*, connecting pieces 8*b* extend rearward respectively, with each connecting piece 8*b* welded to the front end of each one of the pair of right/left bent edge portions 7*a*.

The support frame member 11 has an inner wall 12, an outer wall 13, and a connecting wall 14 interconnecting the rear end of the inner wall 12 and the rear end of the outer wall 13, and the frame member 11 has an angular letter C-like shape.

At a rear end of the side wall 7, there is disposed and fixed by welding, an arcuate-curved attaching plate 16, with its inner side intersecting the side plate 7 in the fowl of letter-T or letter-L-shape. The rear end of the bent edge portion 7*a* is fixed to and superposed on the front end of the attaching plate 16 by means of welding. The bent edge portion 7*a* and the attaching plate 16 together constitute a fender 17 which covers the upper side and the rear side of each traveling device 3.

The inner wall 12 and the outer wall 13 are disposed on the outer side of the side wall 7 of the frame body 9 and front lower ends of the inner wall 12 and the outer wall 13 are fixed by welding respectively to the upper face of the outer portion of the attaching plate 16. With this, the pair of right/left support frame members 11 are fixedly connected via the attaching plate 16 to the respective side walls 7 of the machine body frame 1. Respective upper portions of the inner wall 12, the outer wall 13 and the connecting wall 14 of the support frame member 11 project more upwardly than the lateral walls 7. In this way, while sufficient rigidity of the machine body frame 1 is ensured, the distances between the pair of right/left support frame members 11, a pair of right/left first lift links 81 and the pair of right/left arms 77 can be large, as compared with the right/left width of the frame body 9. With this, the interior comfort of the cabin 4 can be enhanced, with retaining sufficient right/left width of the cabin 4 to be described later.

The upper portions of the inner walls 12 of the pair of right/left support frame members 11 are interconnected by a transverse connecting member 19. This transverse connecting member 19 includes a portal-shaped front wall plate 20, and an upper wall plate 21 that projects rearward from the upper end of the front wall plate 20. A rear portion 21*a* of the upper wall plate 21 is formed with a downwardly rearward inclination. From the right/left opposed ends of the upper wall plate 21, a pair of right/left U-shaped support brackets 22 project upward, respectively. Each one of the pair of right/left support brackets 22 includes a pair of right/left support plate portions 23, each support plate portion 23 defining a front side attaching hole 24 and a rear side retaining hole 25 extending therethrough in the right/left direction.

At rear side intermediate portions of the bottom plate 6 of the frame body 9, there are provided a pair of support decks 26 projecting upward. At the rear end of the frame body 9 and along the rear end of the bottom wall 6, there is provided an extension bottom member 28. This extension bottom member 28 is fixedly welded to the pair of right/left support frame members 11 and fixedly welded to the rear end of the bottom wall 6 of the machine body frame 1. That is to say, the lower ends of the pair of right/left support frame members 11 are interconnected via the extension bottom member 28. The extension bottom member 28 is fixedly welded and connected to the bottom wall 6 of the machine body frame 1 and opposed ends of the extension bottom member 28 are fixedly welded to the inner wall 12 or the connecting wall 14, respectively, and the pair of right/left support frame members 11 are connected via the extension bottom member 28 to the bottom wall 6. The extension bottom member 28 includes an extension bottom wall portion 28*a* capable of mounting thereon a rear portion of an engine 101 to be described later and a raised back wall portion 28*b* provided erect at the rear end of the extension bottom wall portion 28*a*.

At a rear upper end of the support frame member 11 and between the inner wall 12 and the outer wall 13, there is provided a first attaching boss 32 having an attaching hole. At the upper front end of the outer wall 13, a stay member 34 projects upwardly rearward. The front end and the lower end of the stay member 34 are fixedly attached by means of e.g. welding, to the outer wall 13 and to the attaching plate 16. Between the stay member 34 and the inner wall 12, there is provided a second attaching boss 36 having an attaching hole. At a lower end of the support frame member 11 and between the inner wall 12 and the outer wall 13, there is provided a third attaching boss 38 having an attaching hole.

As shown in FIGS. 5 through 8, the engine 101 is mounted on the rear side of the bottom wall 6 of the machine body frame 1. More particularly, the engine 101 is mounted on the bottom wall 6, with the right/left side walls 7 covering the respective right/left sides of the engine 101, the transverse connecting member 19 interconnecting the upper portions of the support frame members 11 upwardly of the fore/aft intermediate portion of the engine 101. The right/left center portion of the rear end of the engine 101 is fixedly mounted on the extension bottom member 28 via a vibration damping member 99, and the right/left sides of the front end of the engine 101 are fixedly mounted on the pair of right/left support decks 26 via vibration damping members 100.

The engine 101 includes an engine fan 102 at the rear end thereof and also includes an oil pan 103 at the lower end slightly forwardly of the engine fan 102. To the front end of the engine 101, there is attached a flywheel 104, and from the engine 101 via the flywheel 104, a traveling hydraulic control device 105 and a triple gear pump 106 project forwardly.

In FIGS. 1-7, the transverse connecting member 19 is provided on the rear side of the cabin 4 which will be described later. The rear side of the frame body 9 downwardly of the transverse connecting member 19 comprises an engine room for housing the engine 101. A hood 39 covering the engine room is provided at the rear end of the machine body frame 1 and includes an upper hood cover 41 and a rear hood cover 40.

The upper wall plate 21 is disposed downwardly of the vertical center of the cabin 4 and the rear portion 21*a* of the upper wall plate 21 is inclined downward rearwardly. Rearwardly of the upper wall member 21, the upper hood cover 41 is provided in such a manner as to cover the rear upper side space between the pair of right/left support frame members 11. The front end of the upper hood cover 41 is connected to the rear portion 21*a* of the upper wall plate 21 of the transverse connecting member 19. The upper hood cover 41 is formed with a rearwardly downward inclination in correspondence with the rear portion 21*a* of the upper wall plate 21.

Thus, the total height of the hood 39 located rearwardly of the cabin 4 can be kept low, as compared with the height of the cabin 4. Hence, there hardly occurs blocking of rear view by the hood 39, so that an operator can see also, from inside the cabin 4, the rear lower side of the hood 39, and can effect a work by the loader work machine smoothly.

As shown in FIG. 1, a height 'h1' from the lower end of the machine body frame 1 to the rear end of the upper hood cover 41 is set to be equal to or less than ½ of a height 'H1' from the lower end of the machine body frame 1 to the upper end of the cabin 4. With keeping 'h1' low relative to 'H1', the operator can see, from inside the cabin 4, the rear lower side of the hood 39, and can effect a work smoothly.

The upper wall plate 21 is disposed upwardly of a seat portion 63*a* of the driver's seat 63 to be described later and downwardly of the upper end of a backrest portion 63*b* of the driver's seat 63. The operator inside the cabin 4 can see, as being seated at the driver's seat 63, from the upper side of the backrest portion 63*b* to the rear lower side of the upper wall plate 21 of the transverse connecting member 19, so that the operator can effect a work more smoothly.

Figure 12:
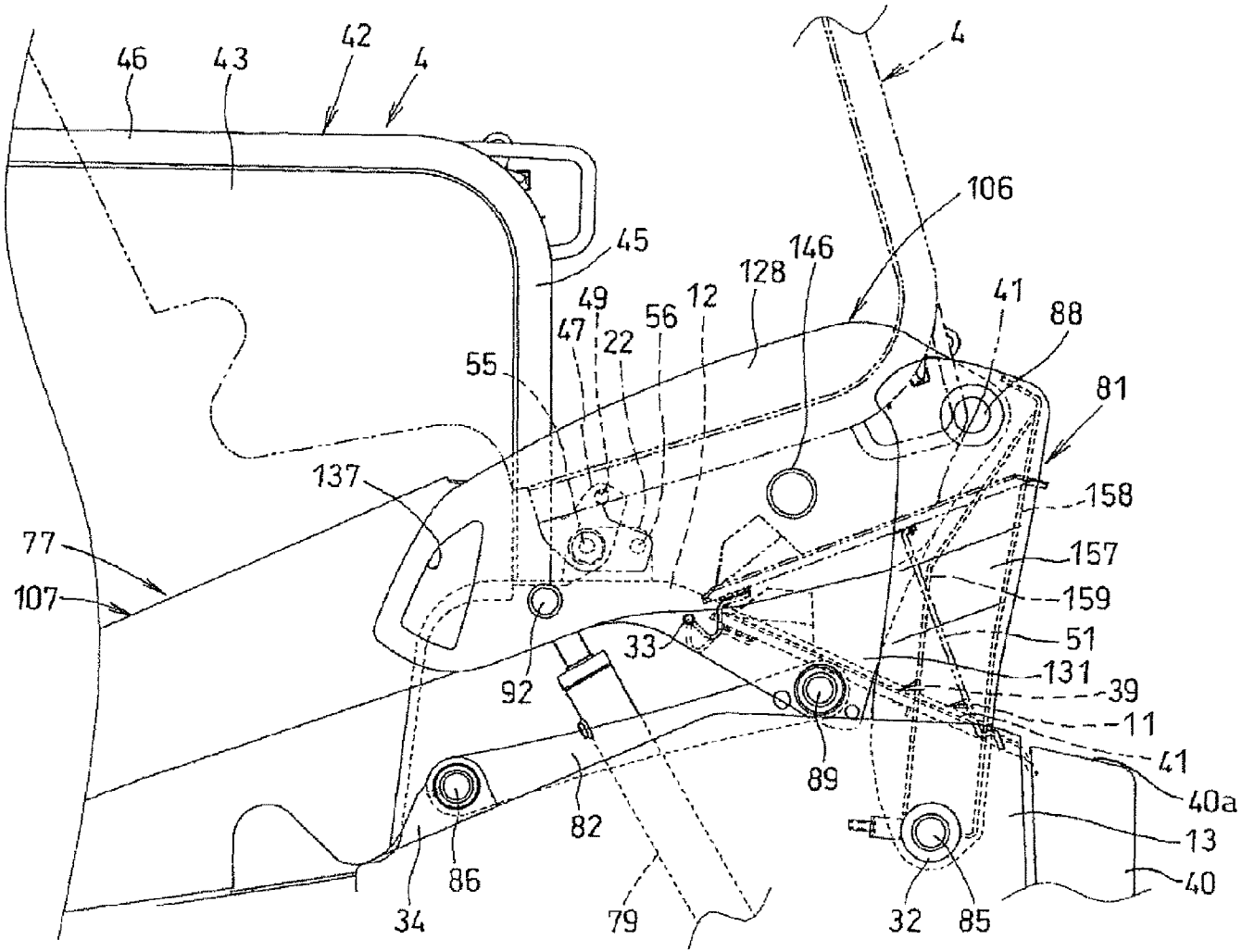
FIG. 12 is a side view showing a hood upper portion and a rear portion of the arm.

As shown in FIG. 12, the upper hood cover 41 covering the upper side of the hood 39 has its front end supported to be vertically pivotable about a support shaft 33 extending in the right/left direction. The upper hood cover 41 can be opened/closed between a closing posture for covering the upper side of the engine room as denoted with a broken line in FIG. 12 and an opened posture where the cover is inclined upwardly rearward for opening up the upper side of the engine room as denoted with a two-dot-and-a-dash line in FIG. 12. Inside the hood 39, there is provided a holding member 51 for holding the upper hood cover 41 under the opened posture.

As shown in FIG. 1, FIG. 2 and FIG. 12, the rear hood cover 40 is provided at the rear end of the support frame member 11 to be pivotable so as to be capable of closing the gap between the rear end of the upper hood cover 41 and the raised back wall portion 28*b* (the rear end opening between the pair of right/left support frame members 11). The upper wall portion 40*a* of the rear hood cover 40 is formed with rearwardly downward inclination in correspondence with the upper hood cover 41. Thus, it is possible for the upper wall portion 40*a* of the rear hood cover 40 not to interfere with the rear view, so that the rear visibility can be improved.

(Construction of Cabin)

As shown in FIGS. 1-7 and FIG. 12, the cabin 4 acting as the ROPS includes a pair of right/left side frame members 42, a roof member mounted and supported between the upper portions of the side frame members 42 and a pair of right/left side wall members 43 attached respectively to the right/left side frame members 42. The cabin 4 has its rear side closed with a rear glass sheet or the like and has its lower fore/aft center portion closed by a bottom wall member 58 to be described later, so that the cabin 4 is constructed like a box with the front side thereof being open. The pair of right/left side frame members 42 are formed of pipes or the like, and include a pair of right/left front post portions 44, a pair of right/left rear post portions 45 and a pair of right/left upper transverse beam portions 46 interconnecting upper ends of the respective front and rear post portions 44, 45.

A pair of right/left attaching brackets 47 project rearward from respective lower ends of the right/left rear post portions 45. The attaching brackets 47 are associated with the respective support brackets 22, each including an attaching hole and a retaining hole 49 in correspondence with the attaching hole 24 and the retaining hole 25 of the support bracket 22 associated therewith. To a lower end each of the right/left front post portions 44, a mounting plate 50 is fixedly attached by means of e.g. welding.

Each side wall member 43 is formed of e.g. a metal plate, and is fixedly attached by means of welding or the like to one of the pair of side frame members 42 associated therewith. The side wall member 43 defines a number of open holes 52 for allowing viewing the outer lateral side from inside the cabin 4, so that the operator can see, through these open holes 52, the arms 77 located on the laterally outer sides and/or the loader implement 2.

In order to allow the cabin 4 to be mounted forwardly of the transverse connecting member 19, a cabin mounting portion capable of mounting the cabin 4 thereon is provided forwardly of the transverse connecting member 19. This cabin mounting portion comprises the bent edge portion 8*a* of the front wall 8, the bent edge portion 7*a* of the side wall, etc. The transverse connecting member 19 is located downwardly of the vertical center of the cabin 4, and upwardly of the transverse connecting member 19, there is provided a support shaft 55 which acts as a pivot for pivoting the cabin 4 rearward and upward.

The support shaft 55 is disposed on the back side of the cabin 4 and at the vertical center of the cabin 4. The hood 39 is disposed downwardly of the support shaft 55. The upper face of the hood 39 (the upper face of the upper wall plate 21 and the upper face of the upper hood cover 41) is disposed either horizontally or with downward inclination toward the rear side, so as not to project more upwardly than the support shaft 55. In this way, the upper face of the hood 39, along its fore/aft entire length, is disposed downwardly of the support shaft 55 and is disposed either horizontally or with downward inclination. As a result, the operator inside the cabin 4 can readily see the wide range of rear lower side of the hood 39, so that the operator can effect a work ever more smoothly.

The support shaft 55 oriented along the right/left direction is inserted to and supported in the attaching hole 24 of the support bracket 22 and the attaching hole of the attaching bracket 47. The cabin 4 is supported via the attaching bracket 47 to the support bracket 22 of the machine body frame 1 to be pivotable about the support shaft 55. With this, the cabin 4 can be switched over in its posture between a mounted state in which the cabin 4 is mounted on the machine body frame 1, with the bottom side thereof closing the upper opening of the machine body frame 1, and a collapsed state in which the bottom side of the cabin 4 is moved upwardly away from the machine body frame 1 to open up the upper opening of the machine body frame 1. When the cabin 4 is pivoted forwardly about the support shaft 55 as shown by the solid line in FIG. 12, the mounting plate 50 comes into contact with and is supported to the upper edge 8*a* of the front wall 8 via a shock absorbing member, whereby the cabin 4 can be maintained under the mounted state. Further, when the cabin 4 is collapsed and pivoted rearwardly about the support shaft 55 as shown by the chain line in FIG. 12, the retaining holes 49 of the pair of attaching brackets 47 come into registry with the retaining holes 25 of the pair of support brackets 22. Then, by inserting retaining pins 56 into the retaining holes 25 and the retaining holes 49, the cabin 4 can be maintained under the forwardly pivoted collapsed state.

In this way, the cabin 4 is pivotally supported to the machine body frame 1. When the cabin 4 is rendered into the mounted state, traveling of the truck loader and/or a work by the loader implement 2 are/is effected. When the cabin 4 is rendered into the collapsed state, e.g. a maintenance operation inside the machine body frame 1 is effected.

As shown in FIG. 2, at the fore/aft center portion at the lower ends of the right/left side wall members 43, the bottom wall member 58 is fixedly connected by means of e.g. welding. The bottom wall member 58 is formed of e.g. a metal plate, includes a bottom wall portion 59 and a pair of right/left side wall portions 60 and is formed as an angular-C shaped component. On the upper face of the bottom wall portion 59 via a cushioning member, there is provided the driver's seat 63.

(Construction of Traveling Device)

In FIG. 1 and FIG. 2, each one of the pair of right/left traveling devices 3 includes a pair of front and rear driven wheels 68, a drive wheel 69 disposed upwardly between the pair of driven wheels 68, and a track frame 73. The track frame 73 is attached integrally by welding to the pair of right/left side walls 7. The traveling device 3 comprises a crawler traveling device with a crawler 70 being entrained around the driven wheels 68 and the drive wheel 69. The traveling device 3 effects driving with rotation of the drive wheel 69 about a drive shaft 71 in association of rotation of this drive shaft 71.

The pair of driven wheels 68 are freely rotatably supported to front and rear opposed ends of the track frame 73 to be rotatable about a transverse shaft respectively. One of the pair of driven wheels 68 is urged in a tension adjusting direction by means of an unillustrated tension adjusting mechanism. Between the pair of driven wheels 68, a plurality of free wheels 72 are provided and each one of these free wheels 72 is supported to the track frame 73 to be freely rotatable about a transverse shaft, respectively. The drive shaft 71 of the traveling device 3 is disposed downwardly of the rear end of the cabin 4.

Each one of the pair of right/left traveling devices 3 includes a hydraulic traveling motor 74 of its own, so that the traveling motor 74 rotatably drives the drive shaft 71 and rotation of the drive shaft 71 drives the drive wheel 69 about the drive shaft 71 via rotation of the drum of the traveling motor 74. With this, each traveling device 3 is driven by each traveling motor 74.

(Construction of Arm)

Figure 9:
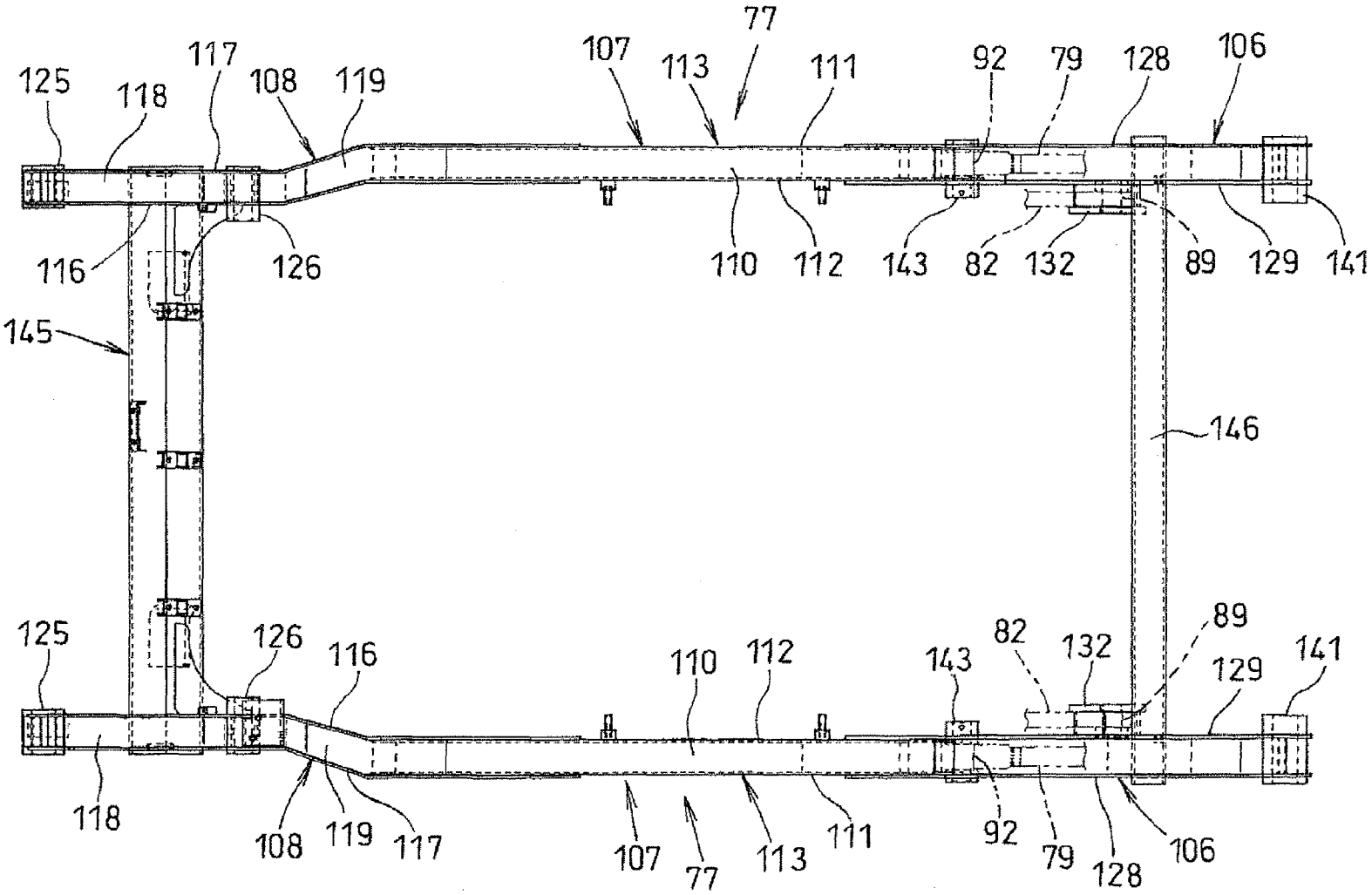
FIG. 9 is a plan view of the arms.
Figure 10:
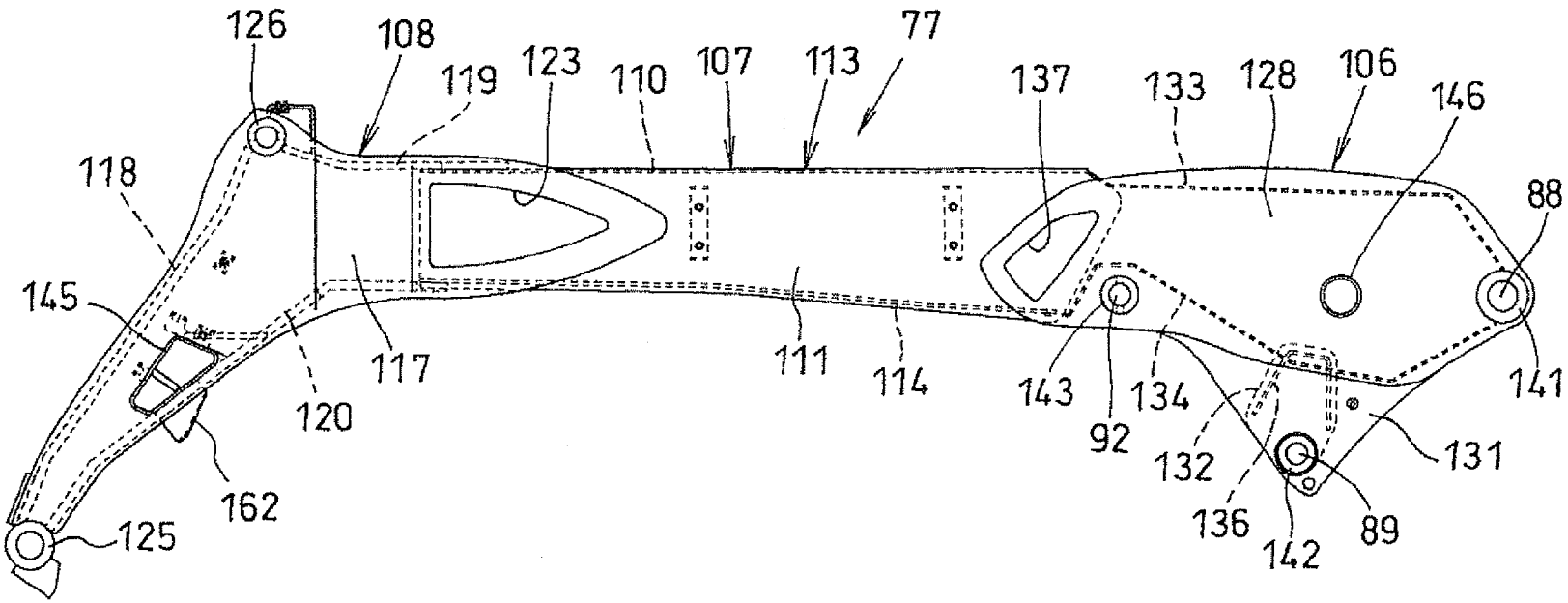
FIG. 10 is a side view of one arm.

In FIGS. 9 and 10, each one of the pair of right/left arms 77 includes, along its longitudinal direction, a base member 106, an intermediate member 107 and a leading end member 108. The intermediate member 107 includes an intermediate member main body 113 which includes a top wall 110, an outer wall 111 and inner wall 112 arranged in the layout of an one-side open rectangular shape, and a bottom wall plate 114 which interconnects the lower end of the outer wall 111 and the lower end of the inner wall 112 of the irate Mediate member main body 113. The intermediate member main body 113 and the bottom wall plate 114 are provided separately of each other. The bottom wall member 114 is fixedly attached by welding to the lower end of the outer wall 111 and the lower end of the inner wall 112.

The leading end member 108 includes an inner wall 116 and an outer wall 117. The leading end member 108 further includes a front connecting wall 118, an upper connecting wall 119 and a lower connecting wall 120 with these walls 118, 119, 120 interconnecting the inner wall 116 and the outer wall 117. Each of the front connecting wall 118, the upper connecting wall 119 and the lower connecting wall 120 is fixedly attached by welding to the inner wall 116 and the outer wall 117.

The rear end of the leading end member 108 is engaged on and welded to the front end of the intermediate member 107. The rear end of the inner wall 116 and the rear end of the outer wall 117 are disposed so as to bind therebetween in the tight/left direction the front end of the intermediate member 107. The opened edge portions of welding holes 123 of the inner wall 116 and the outer wall 117 are welded respectively to the inner wall and the outer wall of the intermediate member 107. The rear end of the upper connecting wall 119 and the rear end of the lower connecting wall 120 are disposed so as to bind vertically therebetween the front end of the intermediate member 107. And, the rear edge portion of the upper connecting wall 120 and the rear edge portion of the lower connecting wall 120 are welded respectively to the top wall 110 and the bottom wall plate 114 of the intermediate member 107.

At the leading end of the leading end member 108, there is provided a cylindrical, leading end connecting boss 125. At an upper intermediate portion of the leading end member 108, there is provided a cylindrical, upper connecting boss 126.

The base member 106 (the base portion of the arm 77) includes an outer wall 128 and an inner wall 129. As an extension of the inner wall 129, there is provided a triangular extension attaching wall 131 which projects downward from the lower edge of the outer wall 128. At the right/left inner side of the extension attaching wall 131, there is provided an inner bracket 132 in opposition to the extension attaching wall 131.

The base member 106 includes an upper connecting wall 133 provided along the upper edge portions of the inner wall 129 and the outer wall 128, and a lower connecting wall 134 provided along the lower edge portions of the inner wall 129 and the outer wall 128. The inner wall 129 and the outer wall 128 are connected to each other via the upper connecting wall 133 and the lower connecting wall 134. A bracket connecting wall 136 is provided along the upper edge portion of the inner bracket 132. The inner bracket 132 is connected, via the bracket connecting wall 136, to the inner face of the extension attaching wall 131 or the inner face of the inner wall 129. An intermediate portion of the bracket connecting wall 136 projects upwards relative to the lower connecting wall 134 such that the bracket connecting wall 136 intersects the lower connecting wall 134 as viewed laterally.

With the intersection between the bracket connecting wall 136 and the lower connecting wall 134 as described above, the projecting base portion of the extension attaching wall 131 of the arm 77 is reinforced by the bracket connecting wall 136 and the lower connecting wall 134 in cooperation with each other. Hence, the support of the second lift link 82 by the extension attaching wall 131 and the inner bracket 132 can be reinforced.

The front end of the base member 106 is engaged on and welded to the rear end of the intermediate member 107. The front end of the inner wall 129 and the front end of the outer wall 128 of the base member 106 are disposed so as to bind therebetween in the right/left direction the rear end of the intermediate member 107. The opened edge portions of welding holes 137 of the inner wall 129 and the outer wall 128 are welded respectively to the inner wall 112 and the outer wall 111 of the intermediate member 107. The front end of the upper connecting well 133 and the front end of the lower connecting wall 134 of the base member 106 are disposed so as to vertically bind therebetween the rear end of the intermediate member 107. The front edge portion of the upper connecting wall 133 and the front edge portion of the lower connecting wall 134 are each welded to the top wall 110 and the bottom wall plate 114 of the intermediate member 107.

At the rear end of the base member 106 and between the inner wall 129 and the outer wall 128, there is provided a first connecting boss 141 having an attaching hole. Between the extension attaching wall 131 and the inner bracket 132, there is provided a second connecting boss 142 having an attaching hole. Forwardly of the first connecting boss 141 and the extension attaching wall 131 and between the inner wall 129 and the outer wall 128, there is provided a third connecting boss 143 having an attaching hole. The rear end of the upper connecting wall 133 and the rear end of the lower connecting wall 134 are connected to the first connecting boss 141. An intermediate portion of the lower connecting wall 134 is disposed upwardly and clear of the third connecting boss 143.

A first arm support shaft 88 is inserted to and held in the first connecting boss 141 via its attaching hole. A second arm support shaft 89 is inserted to and held in the second connecting boss 142 via its attaching hole. An upper cylinder support shaft 92 is inserted to and held in the third connecting boss 143 via its attaching hole.

As shown in FIG. 9 and FIG. 10, the leading end portions of the right/left arms 77 are connected to each other via the front connecting member 145 and the base portions of the right/left arms 77 are connected to each other via the rear connecting member 146. The front connecting member 145 is formed of a pipe member in the form of an angular cylinder. The front connecting member 145 is inserted to the leading ends of the right/left arms 77 (the inner wall 116 and the outer wall 117 of the leading end member 108) and welded to the respective arms 77. The rear connecting member 146 is formed of a cylindrical pipe member. The rear connecting member 146 is inserted to the base end portions of the right/left arms 77 (the inner wall 129 and the outer wall 128 of the base member 106) and welded to the respective arms 77. The right/left arms 77, the front connecting member 145 and the rear connecting member 146 together constitute a rectangular framework. As a result, the rigidity of the pair of right/left arms 77 can be enhanced. So, in the event of application of a large shock from the implement 78 located at the leading ends of the arms 77 during a work for example, mutual torsion or loosening of the pair of right/left arms 77 can be effectively avoided.

As shown in FIG. 1, FIG. 2, FIG. 8 and FIG. 9, intermediate portions on the front end sides of the pair of right/left arms 77 are bent inward in the right/left direction so that the right/left distance between the front ends of the right/left arms 77 is smaller than the fight/left distance between the rear ends of the same.

Figure 8:
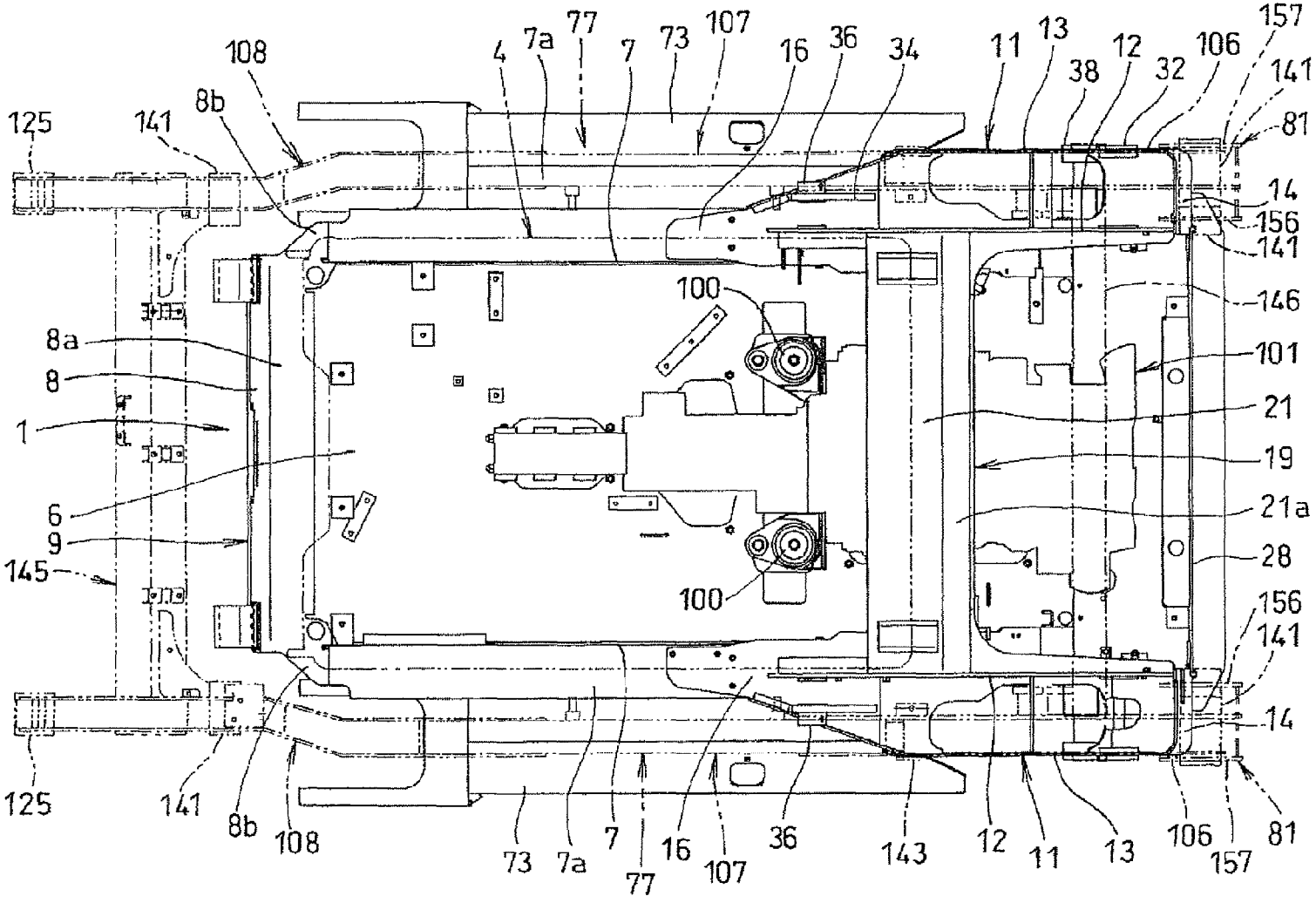
FIG. 8 is a plan view showing positional relationship among the machine body frame, a cabin and arms.

As shown in FIG. 8, the arms 77 are disposed on the right/left sides of the driving section 5 and the cabin 4. The distance between the pair of right/left arms 77 is set greater than the distance between the right/left side walls 7 of the frame body 9. The right/left arms 77 are disposed, along the entire lengths thereof, within the right/left width between the outer ends of the pair of right/left traveling devices 3 and disposed also on the outer side of the right/left width between the inner ends of the pair of right/left traveling devices 3. The right/left width of the cabin 4 is set greater than the distance between the right/left side walls 7 of the frame body 9 and the right/left ends of the cabin 4 project more outward in the right/left direction than the right/left side walls 7 of the frame body 9.

The base pardon of the arm 77, as shown in FIG. 1, FIG. 2 and FIGS. 9-12, is vertically pivotally supported to the rear upper portion of the machine body frame 1 via the rear side first lift link 81 and the front side second lift link 82. Thus, the leading end of the arm 77 can be lifted up/down on the front side of the machine body frame 1. Between the base portions of the pair of right/left arms 77 and the rear lower portion of the machine body frame 1, there are provided a pair of right/left arm cylinders 79 comprised of double-acting type hydraulic cylinders.

The lower base portion of the first lift link 81 is inserted between the inner wall 12 and the outer wall 13 corresponding to the first attaching boss 32, and the first link support shaft 85 is inserted into the attaching hole of the first attaching boss 32 and the lower base portion of the first lift link 81. In this way, the lower base portion of the first lift link 81 is supported to the machine body frame 1 (first attaching boss 32) to be pivotable in the fore/aft direction about the first link support shaft 85.

The front base portion of the second lift link 82 is inserted between the stay member 34 and the inner wall 12 corresponding to the second attaching boss 36 of the machine body frame 1, and the second link support shaft 86 is inserted to the attaching hole of the second attaching boss 36 and the front base portion of the second lift link 82. In this way, the front base portion of the second lift link 82 is supported to the machine body frame 1 (second attaching boss 36) to be pivotable up/down about the second link support shaft 86 at a position forwardly of the first lift link 81.

The lower base end portion of the arm cylinder 79 is inserted between the inner wall 12 and the outer wall 13 corresponding to the third attaching boss 38 of the machine body frame 1. The lower cylinder support shaft 91 is inserted to the attaching hole of the third attaching boss 38 and the lower base portion of the arm cylinder 97. In this way, the lower base portion of the arm cylinder 79 is connected to the machine body frame 1 to be pivotable about the lower cylinder support shaft 91.

With the above-described construction, connection of the upper free end of the first lift link 81 and of the upper leading end of the arm cylinder 79 to the base portion of the arm 77 can be easily done.

The base portion of the arm 77 is pivotally supported by a first arm support shaft 88 to the upper free end of the first lift link 81 to be vertically pivotable about the first arm support shaft 88. Further, forwardly of the first arm support shaft 88, the base portion of the arm 77 is pivotally supported by a second arm support shaft 89 to the free end of the second lift link 82 to be vertically pivotable about the second arm support shaft 89. Further, the upper leading end of the arm cylinder 79 is pivotally connected to the base portion of the arm 77 to be pivotable about the upper cylinder support shaft 92.

Specifically, the upper free end of the first lift link 81 and the upper leading end of the arm cylinder 79 are each pivotally connected between the inner wall 129 and the outer wall 128 of the arm 77. The free end portion of the second lift link 82 is pivotally connected between the extension attaching wall 131 and the inner bracket 132. That is, the upper free end of the first lift link 81 is pivotally connected by the first arm support shaft 88 rearwardly of the extension attaching wall 131, and the upper leading end of the arm cylinder 79 is pivotally connected by the upper cylinder support shaft 92 forwardly of the extension attaching wall 131. The free end of the second lift link 82 is pivotally connected by the second arm support shaft 89, downwardly of a connecting line M interconnecting the first arm support shaft 88 and the upper cylinder support shaft 92.

As described above, since the extension attaching wall 131 projects from the inner wall 129 of the base portion of the arm 77 more downward than the lower edge of the outer wall 128, the outer wall 128 does not present any obstacle when the free end of the second lift link 82 is to be connected between the inner wall 129 of the base portion of the arm 77 and the inner bracket 132. Thus, from the outer side of the arm 77, the second arm support shaft 89 can be easily inserted through the extension attaching wall 131 disposed at the base portion of the arm 77, the inner bracket 132 and the free end of the second lift link 82. As a result, the efficiency of the connecting operation for connecting the first lift link 81, the second lift link 82 and the arm cylinder 79 to the base portion of the arm 77 can be improved.

Furthermore, as the outer wall 128 of the base portion of the arm 77 does not present any obstacle, an operation of injecting grease to the connecting portion between the upper free end of the first lift link 81 and the base portion of the arm 77, the connecting portion between the upper leading end of the arm cylinder 79 and the base portion of the arm 77, from outside the arm 77 becomes easy. Further, an operation of injecting grease to the connecting portion between the free end of the second lift link 82 and the base portion of the arm 77 from outside the arm 77 becomes easy also.

The second arm support shaft 89 and the second link support shaft 86 can, be visually confirmed from outside the machine body frame 1, together with the first link support shaft 85, the first arm support shaft 88, the lower cylinder support shaft 91 and the upper cylinder support shaft 92.

The rear connecting member 146 of the arm 77 is disposed forwardly of the first arm support shaft 88 and disposed also on the connecting line M interconnecting the first arm support shaft 88 and the upper cylinder support shaft 92. With this, when the operator located at the driving section 5 effects a work with viewing the rear side, the operator can guess with a certain level of accuracy, the height position of the implement 78 disposed at the leading end of the arm 77, by seeing the height of the rear connecting member 146 present on the rear side, so that the operator can effect the work easily.

Further, the rear connecting member 146 is disposed closer to the first arm support shaft 88 than the upper cylinder support shaft 92. Therefore, when the arm cylinder 79 lifts up/down the arm 77 in association with expansion/contraction thereof, occurrence of looseness of the right/left lift link 81 to the right or left can be avoided reliably.

When the arm 77 is lowered or lifted down with contraction of the arm cylinder 79 (lowermost state), the rear connecting member 146 is located downwardly of the first arm support shaft 88. When the arm 77 is raised or lifted up with expansion of the arm cylinder 79 (uppermost state), the rear connecting member 146 is located upwardly of the first arm support shaft 88. The upper cylinder support shaft 92 is disposed forwardly of the rear connecting member 146. When the arm 77 is under the lowermost state, the upper cylinder support shaft 92 is located downwardly of the rear connecting member 146. When the arm 77 is under the uppermost state, the upper cylinder support shaft 92 is located upwardly of the rear connecting member 146. The rear connecting member 146 is disposed at a mid position between the first arm support shaft 88 and the upper cylinder support shaft 92.

The rear connecting member 146 is disposed rearwardly of the cabin 4. The rear connecting member 146 and the cabin 4 are disposed apart from each other in the fore/aft direction so that no interference will occur between the cabin 4 and the rear connecting member 146 under the collapsed state of the cabin 4 when the arm 77 is under the lowermost state.

The rear connecting member 146 is disposed upwardly apart from the upper hood cover 41 so that the upper hood cover 41 may be held under its opened posture by the holding member 51 when the arm 77 is under the lowermost state. Even when the arm 77 is lowered, the upper hood cover 41 can be held under the opened posture by the holding member 51, thus providing convenience for e.g. inspection of the inside of the hood 39.

(Stopper Mechanism)

As shown in FIGS. 1-3 and FIG. 5, stopper mechanisms 161 are provided between the front ends of the pair of right/left arms 77 and the front end of the machine body frame 1. When the arms 77 are lowered with contraction of the arm cylinders 79, the rearward reaction force received by the right/left arms 77 from the arms (implement) 78 can be received by the machine body frame 1. The stopper mechanisms 161 include a pair of right/left stoppers 162 projecting rearward from the front connecting member 145 and a pair of right/left receiving members 163 projecting forwardly from the front wall of the machine body frame 1. When the arms 77 are under the lowermost state, the pair of right/left stoppers 162 respectively come into contact or approach the pair of right/left receiving members 163 from the front sides thereof.

(Implement)

Between the front ends of the arms 77, the bucket (implement) 78 is connected via a pair of right/left brackets 95 to leading end connecting bosses 125 to be pivotable about the pivot shaft 97. The bucket 78 is supported via the brackets 95 to the leading ends of the arms 77 to be pivotable about the support shaft 97. Between the brackets 95 of the bucket 78 and the leading end side intermediate portions of the arms 77, there are interposed a pair of right/left bucket cylinders 98 comprised of double-acting type hydraulic cylinders. In response to expansion/contraction of the bucket cylinders 98, the bucket 78 effects a pivoting action (scooping/dumping action).

(First Lift Link)

Figure 11:
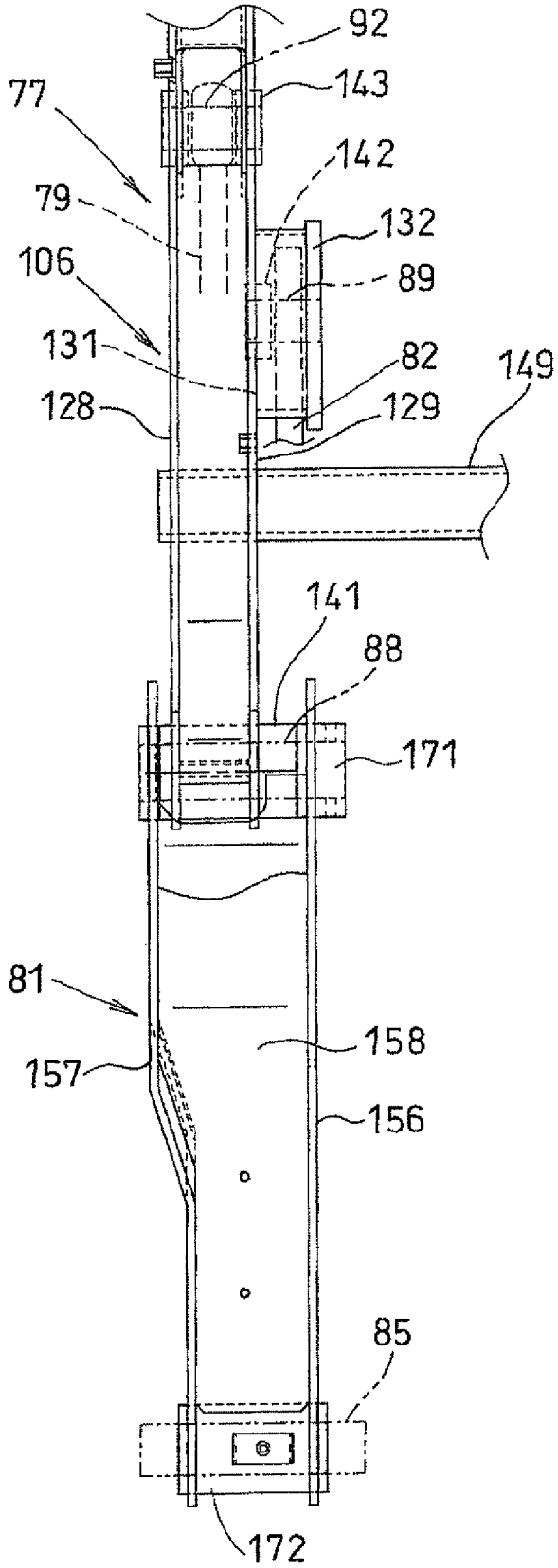
FIG. 11 is a rear view showing a first lift link and the arm when the arm is lifted up.

As shown in FIGS. 11 and 12, the first lift link 81 includes an inner wall 156, an outer wall 157, and a rear connecting wall 158 interconnecting rear ends of the inner wall 156 and the outer wall 157. With this first lift link 81, the inner wall 156, the outer wall 157 and the rear connecting wall 158 together form a one-side opened rectangular shape with its front side open. Further, the first lift ink 81 includes an intermediate portion connecting wall 159 interconnecting fore/aft intermediate portions of the inner wall 156 and the outer wall 157.

Between the inner wall 156 and the outer wall 157 at the upper free end of the first lift link 81, there is provided an upper support boss portion 171, and between the inner wall 156 and the outer wall 157 at the base portion of the first lift link 81, there is provided a lower support boss portion 172. As shown in FIG. 11, between the upper ends of the inner wall 156 and the outer wall 157 of the first lift link 81, there is engaged the first connecting boss 141 side of the base portion of the arm 77. The first arm support shaft 88 is inserted into the first connecting boss 141 and the upper support boss portion 161. With this, the base each of the pair of right/left arms 77 is pivotally supported by the first arm support shaft 88, and the base each of the arms 77 is supported to be vertically pivotable about the first arm support shaft 88.

As shown in FIG. 8, the pair of right/left link links 81 are disposed respectively on the outer sides of the right/left side walls 7 of the frame body 9. The lower base portion each of the pair of right/left first lift links 81 is pivotally supported by the first link support shaft 85 between the inner wall 12 and the outer wall 13 of the support frame member 11. That is to say, the base portions of the pair of right/left arms 77 are pivotally supported by the respective first arm support shafts 88, on the outer sides of the Side walls 7 of the frame body 9 and on the upper free end sides of the first lift links 81. And, the bases of the pair of right/left arms 77 are disposed on the outer sides of the frame body 9.

Thus, it is possible to cause the right/left opposed sides of the cabin 4 mounted on the machine body frame 4 to project more outwards in the right/left direction than the right/left side walls 7 of the frame body 9. Therefore, it is possible to set the right/left width of the cabin 4 greater than the distance between the right/left side walls 7 of the frame body 9. Then, even when the loader work machine is formed compact with reduction in the right/left width of the frame body 9 for instance, a sufficient right/left width can be secured for the cabin 4, thus improving the occupant comfort of the cabin 4.

However, as described above, the right/left arms 77 are disposed along the entire lengths thereof, within the right/left width between the outer ends of the right/left traveling devices 3 and also disposed on the outer sides of the right/left width between the inner ends of the pair of right/left traveling devices 3. So, even if a sufficient right/left width is secured for the cabin 4, it is still possible to restrict the right/left width of the entire loader work machine within the right/left width of the right/left traveling devices 3. Accordingly, the occupant comfort of the cabin 4 can be enhanced without enlargement of the loader work machine, so the workability of the machine in a narrow limited space is not impaired.

Further, as shown in FIG. 11, the upper free end of the first lift link 81 is formed wide so as to project on the outer side in the fight/left direction relative to the lower base portion thereof. The base portions of the right/left arms 77 are supported with an outward offset in the fight/left direction relative to the upper free ends of the pair of right/left first lift links 81. In this way, the base portion of the arm 77 is offset to the outer side in the right/left direction relative to the lower base portion of the first lift link 81. As a result, as compared with the departing width between the lower base portions of the right/left first lift links 81 and the departing width between the right/left support frame members 11, it is possible to set the departing width between the base portions of the right/left arms 77 large. This arrangement also allows securing of sufficient right/left width of the cabin 4, thus enhancing the occupant comfort of the cabin 4.

(Arm Cylinder)

As shown in FIG. 9, FIG. 11 and FIG. 12, the upper leading end of the arm cylinder 79 is inserted between the outer wall 128 and the inner wall 129 of the base portion of the arm 77. To the upper leading end of this arm cylinder 79, there is inserted the upper cylinder support shaft 92 which in turn is inserted into the third connecting boss 143 and the upper leading portion of the arm cylinder 79 is pivotally connected to the base portion of the arm 77 by the upper cylinder support shaft 92.

(Second Lift Link 82)

The free end of the second lift link 82 is inserted between the extension attaching wall 131 and the inner bracket 132. To the free end of this second lift link 82 through the second connecting boss 142, the second arm support shaft 89 is inserted, and the free end of the second lift link 82 is pivotally connected via the second arm support shaft 89 to the base portion of the arm 77. With this, the base portion of the arm 77 is supported to the free end of the second lift link 82 to be vertically pivotable about the second arm support shaft 89, at a position forwardly of the first arm support shaft 88.

The second lift link 82 is disposed on the inner side in the right/left direction relative to the arm cylinder 79, so that the arm cylinder 79 and the second lift link 82 can cross or intersect with each other as viewed laterally.

(Layouts of Respective Shafts)

As shown in FIG. 1 and FIG. 2, the positional relationship among the first link support shaft 85, the second link support shaft 86, the first arm support shaft 88 and the second arm support shaft 89 is set such that the first lift link 81 as a whole may be substantially confined forwardly of the rear end of the vehicle body (the rear end of the rear hood cover 40) of the loader work machine, over the entire range of lifting operation of the arm 77 from the lowermost state to the uppermost state. That is, the positional relationship among the first link support shaft 85, the second link support shaft 86, the first arm support shaft 88 and the second arm support shaft 89 is set such that the upper portion of the first lift link 81 may be substantially confined forwardly of the rear end of vehicle body of the loader work machine.

Thus, there occurs no significant projection of the first lift link 81 from the vehicle body rear end of the loader work machine over the entire lifting process of the arm 77, which prevents the first lift link 81 from becoming an obstacle during a work by colliding with an object present rearwardly of the loader work machine. Therefore, it is possible to avoid contact of the first lift link 81 with an object present on the rear side, when the loader work machine is traveled backward. Further, as no significant rearward projection of the first lift link 81 occurs, working performance at a narrow limited space is improved. Further, if the first lift link 81 projected significantly rearward, the presence of this first lift link would-hinder the obliquely rearward view, thus impairing the oblique rearward visibility. With the present construction, on the other hand, since the first lift link does not significantly project rearward, good obliquely rearward view is obtained.

When the arm 77 is lifted up and the second link support shaft 86, the first arm support shaft 88 and the second arm support shaft 89 are brought into alignment with a straight line, as shown by the dot-and-dash line in FIG. 2, the first lift ink 81 is maximally inclined rearward. Under this condition, the first arm support shaft 88 is located forwardly of the vehicle body rear end (the rear end of the rear hood cover 40) of the loader work machine (truck loader). Over the entire range of lifting up/down operation of the arm 77, the fore/aft position of the upper portion of the first lift link 81 is in approximate agreement with the position of the vehicle body rear end (rear end of the rear hood cover 40), when the upper free end of the first lift link 81 is maximally inclined rearward.

In this way, when the upper free end of the first lift link 81 is maximally inclined rearward, even if the first lift loader 81 projects rearwardly from the vehicle body rear end of the loader work machine, there occurs only slight rearward projection of the first lift link 81, so there will hardly occur any obstacle by the first lift link 81 during a work.

When the arm 77 assumes the lowermost state, the second arm support shaft 89 projects toward the first link support shaft 95, from a segment interconnecting the second link support shaft 86 and the first arm support shaft 88. Also, a segment interconnecting the second link support shaft 86 and the second arm support shaft 89 intersects, at an obtuse angle, with a segment interconnecting the first arm support shaft 88 and the second arm support shaft 89. With this arrangement, when the arm 77 is lowered in response to contraction of the arm cylinder 79, the first lift link 81 will be pivoted rearward about the first link support shaft 85 and then pivoted back slightly forwardly.

Therefore, maximal rearward pivoting movement of the rear free end of the first lift link 81 occurs only during the lifting movement of the arm 77. Even if the first lift link 81 projects rearward from the vehicle body rear end, this occurs only during the limited period in the course of the lifting up/down operation of the arm 77. In this regard too, the first lift link 81 will hardly become an obstacle during a work.

The first lift link 81 is formed longer than the second lift link 82, so that the distance between the first link support shaft 85 and the first arm support shaft 88 is set longer than the distance between the second link support shaft 86 and the second arm support shaft 89. And, the distance between the first arm support shaft 88 and the second arm support shaft 89 is set shorter than the distance between the first link support shaft 85 and the first arm support shaft 88. Further, the second link support shaft 86 is disposed forwardly of the drive shaft 71 of the traveling device 3.

Figure 13:
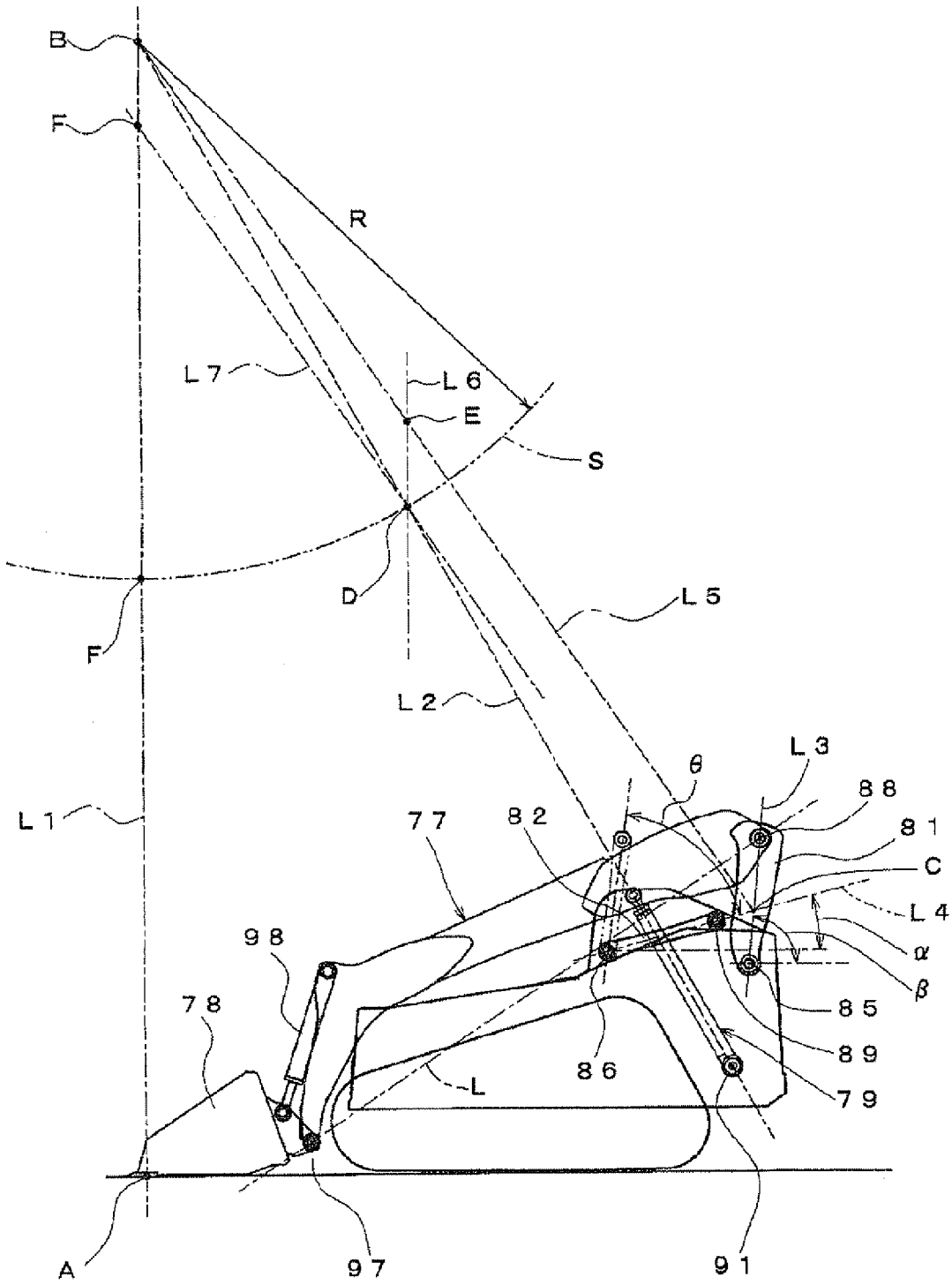
FIG. 13 is an explanatory view for explaining a lift-up force, a ground cutting force and an excavating force of the implement by expanding/contracting operation of an arm cylinder associated with the arm.

As shown in FIG. 2, FIG. 9 and FIG. 13, when the atm 77 assumes the lowermost state, the first lift link 81 is inclined upwardly rearward and the first arm support shaft 88 is located rearwardly of the first link support shaft 85, and also the first link support shaft 85 is located rearwardly of the lower cylinder support shaft 91.

(Lifting Up/Down Operation of Arm)

When the arm 77 assumes the lowermost state, the pair of right/left second lift links 82 are inclined upwardly rearward. And, over the entire range of lifting up/down operation of the arm 77, the pair of right/left lift links 82 maintain this upwardly rearwardly inclined condition. Also, in association with lifting up/down operation of the arm 77 in response to expansion/contraction of the arm cylinder 79, the second lift link 82 is vertically pivoted about its base portion (the second link support shaft 86) by a range θ, which is smaller than 90 degrees.

As shown in FIG. 13, under the lowered state of the arm 77, the arm cylinder 79 extends substantially perpendicular to a connecting line L interconnecting the first arm support shaft 88 of the arm 77 and the implement support shaft 97.

As described above, under the lowermost state of the arm 77 where the implement 78 is placed on the ground surface, the pair of right/left second lift links 82 are inclined upwardly rearward. With this arrangement, as shown in FIG. 13, in comparison with an arrangement of the second lift links 82 being disposed horizontal rearwardly, a virtual intersection point C is shifted rearward and an intersection point connecting line L5 is inclined rearward about an action intersection point B. As a result, the length between the intersection points DE representing the magnitude of the force of the arm cylinder 79 for lifting up the implement 78 and the length between the points BF are increased, and the lifting-up force of the arm 77 from its lowermost state in association with expansion movement of the arm cylinder 79 is increased correspondingly, thus increasing the ground cutting or excavating force of the implement 78.

That is to say, in FIG. 13, a line extended perpendicularly upward from the action point A of the implement 78 is set as an extension line L1; a line upwardly extended from the arm cylinder 79 is set as a cylinder extension line L2; and an intersection point between the extension line L1 and the cylinder extension line L2 is set as the action intersection point B. A line extended from the first lift link 81 is set as a first link extension line L3; and line extended from the second lift link 82 is set as a second link extension line L4. An intersection point between the first link extension line L3 and the second link extension line is set as the virtual intersection point C, and a line connecting between the virtual intersection point C and the action intersection point B is set as an intersection point connecting line L5. And, a thrust arc S having a radius R corresponding to the magnitude of the cylinder thrust force of the arm cylinder 97 is drawn about the action intersection point B, and an intersection point between the thrust arc S and the cylinder extension line L2 is set as a thrust intersection point D. Further, a perpendicular line L6 extending perpendicularly from the thrust intersection point D is drawn, and the intersection point between this perpendicular line L6 and the intersection point connecting line L5 is set as a first intersection point E. And, a parallel line L7 extending parallel with the intersection point connecting line L5 is drawn from the thrust intersection point D, and the intersection point between the parallel line L7 and the perpendicular extension line L1 is set as a second intersection point F.

In this case, the length between the intersection points BE, i.e. the distance between the points DE is the lifting force of the implement 78, with the radius R of the thrust arc S being the magnitude of the cylinder thrust. A parallelogram is formed with interconnecting the points B, E, D, F. The length between the points BD (radius R) corresponding to the magnitude of the cylinder thrust can be divided into the length between the points BF and the length between the points BE. In this way, the length between the intersection points BF, i.e. the length between the points DE, corresponds to the lifting force of the implement 78 by the cylinder thrust of the arm cylinder 79.

Therefore, with the arrangement of the second lift link 82 being inclined upwardly rearward under the lowermost state of the arm 77, in comparison with the arrangement of e.g. the second lift link 82 being horizontal rearwardly or downwardly inclined rearward, the virtual intersection point C is shifted rearward and the intersection point connecting line L5 is inclined more rearwardly about the action intersection point B. Thus, the length between the intersection points DE, that is, the length between the points BF is increased, thus increasing the lifting-up force of the implement 78 with an expansion movement of the arm cylinder 79 from the lowermost state of the arm 77. As a result, the ground cutting force or excavating force of the implement 78 too is increased correspondingly and the implement 78 can be lifted up more smoothly.

Further, the first arm support shaft 88 is disposed rearwardly of the first link support shaft 85. When the arm 77 is lowered, the first lift link 81 is inclined upwardly rearward. Therefore, compared with the arrangement of the first lift link 81 being inclined upwardly forward or straight upward, the virtual intersection point C is shifted rearward and the intersection point connecting line L5 is inclined more rearwardly about the action intersection point B. Thus, the length between the intersection points DE, that is, the length between the points BF is increased, thus increasing the lifting-up force of the implement 78 with an expansion movement of the arm cylinder 79 from the lowered state of the arm 77. As a result, the ground cutting force or excavating force of the implement 78 too is increased correspondingly and the implement 78 can be lifted up more smoothly.

Further, the first link support shaft 85 is disposed rearwardly of the lower cylinder support shaft 91. Thus, compared with the arrangement of the first link support shaft 85 being disposed forwardly of the lower cylinder support shaft 91, the first lift link 81 is disposed more rearwardly relative to the machine body frame 1, so the virtual intersection point C is shifted rearward and the intersection connecting line L5 is pivoted more rearward about the action intersection point B. Thus, the length between the intersection points DE, that is, the length between the points BF is increased, thus increasing the lifting-up force of the implement 78 with an expansion movement of the arm cylinder 79. As a result, the ground cutting force or excavating force of the implement 78 too is increased correspondingly and the implement 78 can be lifted up more smoothly.

Under the lowered state of the arm 77, the arm cylinder 79 extends substantially perpendicular to the connecting line L interconnecting the first arm support shaft 88 and the implement support shaft 97. Thus, the cylinder thrust force can be transmitted in an efficient manner to the arm 77 in association with the expanding movement of the arm cylinder 79 from the lowered state of the arm 77. As a result, the lifting-up force of the implement 78 is increased and the ground cutting force or excavating force of the implement 78 is increased, and the implement 78 can be lifted up smoothly.

Over the entire range of lifting up/down operation of the arm 77, the pair of right/left second lift links 82 are maintained under the rearwardly upwardly inclined state. Hence, in comparison with the arrangement of the second lift links 82 being horizontal rearwardly or downwardly rearwardly inclined, the virtual intersection point C shown in FIG. 13 is shifted rearward. Further, since the second lift link 82 is upwardly rearwardly inclined over the entire range of the lifting up/down operation of the arm 77, in association with a lifting movement of the arm 77 from its lowermost state, an inclination angle α of the second lift link 82 will be progressively increased. When the forward pivotal movement of the first lift link 81 is small, in association with increase in the inclination angle α of the second lift link 82, the virtual intersection point C will be progressively shifted rearward. In association with increase in the forward pivotal movement of the first lift link 81, the inclination angle α of the second lift ink 82 will be increased, so that it is possible to restrict forward displacement of the virtual intersection point C due to the forward pivotal movement of the first lift link 81. As a result, it is possible to maintain maximum the length between the intersection points DE, i.e. the length between the points BF, over the entire range of the lifting-up operation of the arm 77.

In the course of the lifting-up movement of the arm 77, if the inclination angle α of the second lift link 82 exceeds 90 degrees and the second lift link 82 is inclined upwardly forwardly about the second link support shaft 86, this will result in significant forward displacement of the virtual intersection point C, so that there will occur significant forward pivotal displacement of the intersection point connecting line L5 about the action intersection point B Thus, there will occur sudden shortening in the length between the intersection points DE, i.e. the length between the points BE in the course of the lifting-up operation of the arm 77, and thus sudden reduction in the lifting-up force of the implement 78. With the above-described inventive construction, on the other hand, there occurs no forwardly upward inclination of the second lift link 82 in the course of lifting-up operation of the arm 77, so that the implement 78 can be lifted up smoothly over the entire range of the lifting-up operation of the arm 77.

Further, in response to the lifting up/down operation of the arm 77 in association with expansion/contraction of the arm cylinder 79, the second lift link 82 is vertically pivoted about its base (second link support shaft 86) over the range θ that is smaller than 90 degrees. Thus, there will occur no gradual change in the lifting-up force of the implement 78 by the expansion operation of the arm cylinder 79 from the lowermost state of the arm 77, which would result in significant reduction in the lifting-up force. Therefore, the implement 78 can be lifted up in a smooth manner.

Incidentally, in the present embodiment, the pair of right/left traveling devices 3 comprise crawler traveling devices having the driven wheels 68, the drive wheel 69 and the cruder 70 entrained around them. Instead, the pair of right/left traveling devices 3 can be tired front wheels and rear wheels.

In the foregoing embodiment, the rear connecting member 146 and the cabin 4 are disposed away from each other in the fore/aft direction so as to avoid interference between the cabin 4 and the rear connecting member 146 if the cabin 4 is rendered into the collapsed state under the lowered state of the arm 77. Instead of this, a different arrangement is possible wherein, if the cabin 4 is rendered into the collapsed state under the lowered state of the arm 77, the back side of the cabin 4 comes into contact with the rear connecting member 146, thus retaining the cabin under the collapsed state.

In the foregoing embodiment, grease is injected to the portions of connecting the first lift link 81, the arm cylinder 79 and the second lift link 82 with the arm 77. Instead of this, lubricating oil other than grease may be injected to the portions of connecting the first lift link 81, the arm cylinder 79 and the second lift link 82 with the arm 77.

In the foregoing embodiment, the track frames 73 of the pair of right/left traveling devices 3 are mounted integrally by means of welding thereof to the pair of right/left side walls 7 of the frame main body 9. Instead of this, the track frames 73 of the pair of right/left traveling devices 3 can be mounted detachably by means of fasteners such as bolts/nuts, to the pair of right/left side walls 7 of the frame main body 9.

In the foregoing embodiment, the pair of right/left traveling devices 3 comprise crawler traveling devices having the driven wheels 68, the drive wheel 69 and the crawler 70 entrained around them. Instead, the pair of right/left traveling devices 3 can be tired front wheels and rear wheels.

INDUSTRIAL APPLICABILITY

The present invention is applicable to a loader work machine capable of preventing significant rearward projection of the first lift cylinder from the rear end of the vehicle body of the loader work machine in the course of lifting up/down the arm, thus preventing the first lift link from hitting an object present rearwardly of the loader work machine, thus preventing the first lift link from interfering with the work.

The invention claimed is:

1. A loader work machine comprising:

a driving section provided upwardly of a machine body frame;

a pair of right/left arms provided on right/left sides of the machine body frame and the driving section, respectively;

an implement provided between leading ends of the pair of right/left arms;

a pair of right/left traveling devices supporting the machine body frame;

a pair of right/left first lift links and a pair of right/left second lift links disposed forwardly of the first lift links for vertically pivotally supporting base portions of the respective arms at a rear upper portion of the machine body frame;

an arm cylinder provided between the base portion of each arm and a rear lower portion of the machine body frame for lifting up/down the arm;

a first link support shaft for pivotally supporting a lower base portion of the first lift link associated therewith to the machine body frame;

a second link support shaft for pivotally connecting a base portion of the second lift link associated therewith to the machine body frame, at a position forwardly of the first link support shaft;

a first arm support shaft for pivotally supporting a base portion of the arm associated therewith to an upper free end of the first lift link;

a second arm support shaft for pivotally connecting a base portion of the arm associated therewith to a free end of the second lift link, at a position forwardly of the first arm support shaft;

a lower cylinder support shaft for pivotally connecting a lower end of the arm cylinder associated therewith to the machine body frame; and an upper cylinder support shaft for pivotally connecting an upper leading end portion of the arm cylinder associated therewith to the base portion of the arm;

a leading end of the arm being lifted up/down forwardly of the machine body frame;

wherein positional relationship among the first link support shaft, the second link support shaft, the first arm support shaft and the second arm support shaft is set such that an upper portion of the first lift link comes into substantial agreement with a rear end of the machine body, when the upper free end of the first lift link is pivoted maximally rearward in the course of transition of the arm from a lowermost state realized by lifting down the arm in response to contraction of the arm cylinder to an uppermost state realized by lifting up the arm in response to expansion of the arm cylinder;

under the lowermost state, the second lift link is inclined upwardly rearward;

under the lowermost state, the first arm support shaft is located rearwardly of the first link support shaft; and the first link support shaft is disposed rearwardly of the lower cylinder support shaft.

2. The loader work machine according to claim 1, wherein the first arm support shaft is provided at the upper end of the first lift link, and when the arm associated therewith is lifted up/down to bring the second link support shaft, the first arm support shaft and the second arm support shaft into alignment with a straight line, the first lift link is inclined upwardly rearward and the first arm support shaft is positioned forwardly of the rear end of the machine body.

3. The loader work machine according to claim 1, wherein under the lowermost state, the second arm support shaft projects toward the first link support shaft from a segment interconnecting the second link support shaft and the first arm support shaft, and a segment interconnecting the second link support shaft and the second arm support shaft intersects at an obtuse angle with a segment interconnecting the first arm support shaft and the second arm support shaft.

4. The loader work machine according to claim 1, wherein a distance between the first link support shaft and the first arm support shaft is set longer than a distance between the second link support shaft and the second arm support shaft.

5. The loader work machine according to claim 1, wherein a distance between the first arm support shaft and the second arm support shaft is set shorter than a distance between the first link support shaft and the first arm support shaft.

6. The loader work machine according to claim 1, wherein the second link support shaft is disposed forwardly of a drive shaft of the traveling device associated therewith.

7. The loader work machine according to claim 1, wherein under the lowermost state, each arm cylinder is disposed substantially perpendicular to a connecting line interconnecting the first arm support shaft and an implement support shaft that pivotally connects the implement to the leading end of the arm associated therewith.

8. The loader work machine according to claim 1, wherein in the course of transition from the lowermost state of each arm to the uppermost state of the same, the second lift link is always inclined upwardly rearward.

9. The loader work machine according to claim 1, wherein with lift up/down operation of each arm in response to expansion/contraction of the arm cylinder associated therewith, the second lift link is vertically pivoted within a range smaller than 90 degrees.

10. A loader work machine comprising:

a pair of right/left arms provided on right/left sides of a machine body frame and a driving section, respectively;

an implement provided between leading ends of the pair of right/left arms;

a pair of right/left traveling devices supporting the machine body frame;

a pair of right/left first lift links and a pair of right/left second lift links disposed forwardly of the first lift links for vertically pivotally supporting base portions of the respective arms at a rear upper portion of the machine body frame;

an arm cylinder provided between the base portion of each arm and a rear lower portion of the machine body frame for lifting up/down the arm;

a first link support shaft for pivotally supporting a lower base portion of the first lift link associated therewith to the machine body frame;

a second link support shaft for pivotally connecting a base portion of the second lift link associated therewith to the machine body frame, at a position forwardly of the first link support shaft;

a first arm support shaft for pivotally supporting a base portion of the arm associated therewith to an upper free end of the first lift link;

a second arm support shaft for pivotally connecting a base portion of the arm associated therewith to a free end of the second lift link, at a position forwardly of the first arm support shaft;

a lower cylinder support shaft for pivotally connecting a lower end of the arm cylinder associated therewith to the machine body frame; and an upper cylinder support shaft for pivotally connecting an upper leading end portion of the arm cylinder associated therewith to the base portion of the arm;

wherein, when the arm cylinder is retracted to lower the arm associated therewith, the first link support shaft is positioned immediately below the first arm support shaft, the second arm support shaft is positioned forwardly and upwardly of the first link support shaft, and the second link is disposed with forward and downward inclination from the second arm support shaft toward the second link support shaft so that a line extending through the second link support shaft and the second arm support shaft intersects the first lift link; and wherein positional relationship among the first link support shaft, the second link support shaft, the first arm support shaft and the second aim support shaft is set such that an upper portion of the first lift link comes into substantial agreement with a rear end of the machine body, when the upper free end of the first lift link is pivoted maximally rearward in the course of transition of the arm from a lowermost state realized by lifting down the arm in response to contraction of the arm cylinder to an uppermost state realized by lifting up the arm in response to expansion of the arm cylinder.

* * * * *

UNITED STATES PATENT AND TRADEMARK OFFICE

CERTIFICATE OF CORRECTION

PATENT NO. : 8,545,163 B2
APPLICATION NO. : 12/529970
DATED : October 1, 2013
INVENTOR(S) : Toyoaki Yasuda et al.

It is certified that error appears in the above-identified patent and that said Letters Patent is hereby corrected as shown below:

In the Claims

Column 22, Line 41, Claim 10, delete "aim" and insert -- arm --

Signed and Sealed this
Eighteenth Day of February, 2014

Michelle K. Lee

Michelle K. Lee
*Deputy Director of the United States Patent and Trademark Office*